US006705712B2

(12) United States Patent
Usui et al.

(10) Patent No.: US 6,705,712 B2
(45) Date of Patent: Mar. 16, 2004

(54) INK CARTRIDGE, INK JET RECORDING DEVICE USING THE SAME, AND METHOD FOR CONTROLLING THE CLEANING OF A RECORDING HEAD OF THE INK JET RECORDING DEVICE

(75) Inventors: Minoru Usui, Nagano (JP); Kazuhiko Hara, Nagano (JP); Kiyotaka Sema, Tokyo (JP); Takahiro Naka, Nagano (JP); Hitoshi Hayakawa, Nagano (JP); Satoshi Shinada, Nagano (JP); Masaru Takahashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/955,596

(22) Filed: Sep. 18, 2001

(65) Prior Publication Data

US 2002/0085060 A1 Jul. 4, 2002

Related U.S. Application Data

(63) Continuation of application No. PCT/JP01/00231, filed on Jan. 16, 2001.

(30) Foreign Application Priority Data

| | | |
|---|---|---|
| Jan. 8, 2000 | (JP) | P2000-009205 |
| Aug. 23, 2000 | (JP) | P2000-252474 |
| Aug. 30, 2000 | (JP) | P2000-260590 |

(51) Int. Cl.[7] ..... B41J 2/175
(52) U.S. Cl. ..... 347/86; 347/85
(58) Field of Search ..... 347/85, 86, 87; 401/40

(56) References Cited

U.S. PATENT DOCUMENTS

| | | | | |
|---|---|---|---|---|
| 3,720,473 A | * | 3/1973 | Nakata | 401/40 |
| 5,933,172 A | * | 8/1999 | Park et al. | 347/85 |
| 6,000,788 A | | 12/1999 | Iida | 347/86 |
| 6,036,305 A | | 3/2000 | Nagasaki et al. | 347/86 |
| 6,050,670 A | * | 4/2000 | Tooyama et al. | 347/29 |
| 6,325,484 B1 | | 12/2001 | Usui | 347/30 |

FOREIGN PATENT DOCUMENTS

| | | | |
|---|---|---|---|
| EP | 0 442 471 A1 | 8/1991 | |
| EP | 0 778 145 A1 | 6/1997 | |
| EP | 0 882 595 A2 | 12/1998 | |
| EP | 1 043 161 A2 | 10/2000 | B41J/2/165 |
| JP | 4-1055 | 1/1992 | B41J/2/175 |
| JP | 2822586 | 9/1998 | B41J/2/18 |
| JP | 11-348310 | 12/1999 | B41J/2/175 |

OTHER PUBLICATIONS

International Search Report.
Patent Abstracts of Japan 04001055, vol. 016, No. 141, Apr. 9, 1992.

* cited by examiner

*Primary Examiner*—Anh T. N. Vo
(74) *Attorney, Agent, or Firm*—Sughrue Mion, PLLC

(57) ABSTRACT

An ink flow passage 7*f* is formed from an ink storage chamber of an ink cartridge 7 to an ink supply port. A passage control system 7*j* is located in the ink flow passage. The passage control system is capable of opening and closing the ink flow passage when receiving a drive force from an actuator 32. Particularly, air bubbles A1 staying on a filter member 22 within an ink supplying needle 21 is effectively discharged to a capping system 9 in a manner that a negative pressure is accumulated in an inner space of the capping system 9 in a state that the passage control system 7*j* is placed to a valve closing state. The passage control system 7*j* is provided in the ink cartridge. Accordingly, every time the ink cartridge is exchanged with a new one, the passage control system 7*j* is also exchanged with a new one. Accordingly, the printing function restoring operation performed through a cleaning operation based on the negative pressure accumulation is improved in reliability.

25 Claims, 21 Drawing Sheets

INK CARTRIDGE, INK JET RECORDING DEVICE USING THE SAME, AND METHOD FOR CONTROLLING THE CLEANING OF A RECORDING HEAD OF THE INK JET RECORDING DEVICE

CROSS-REFERENCE TO RELATED APPLICATIONS

This is a continuation application of International Application No. PCT/JP01/00231 filed on Jan. 16, 2001.

TECHNICAL FIELD

The present invention relates to an ink jet recording device which includes a recording head being movable in the widthwise direction of a recording sheet of paper, and ejects from the recording head ink droplets toward a recording sheet in accordance with print data, thereby printing an image on the recording sheet. More specifically, the invention relates to an ink cartridge to which a cleaning process is effectively applicable for sucking ink from the nozzle apertures of the recording head to restore the printing function of the recording head, and an ink jet recording device using the ink cartridge, and a method for controlling the cleaning of the recording head of the ink jet recording device.

BACKGROUND ART

The ink jet recording device includes an ink jet recording head for receiving ink from an ink cartridge and a sheet feeder for moving a recording sheet relative to the recording head. The recording head mounted on a carriage ejects ink droplets onto the recording sheet while being moved in the widthwise direction of the recording sheet, thereby executing recording.

The recording head which is able to eject black ink and color ink of yellow, cyan and magenta is mounted on the carriage, so that not only text printing with black ink but also full color printing by varying a ejecting ratio of color ink can be executed.

The recording head mentioned above suffers from a problem in that print failure may occur due to increased ink viscosity or solidification of ink, which will be caused, for instance, due to evaporation of solvent from nozzle apertures, adhered dust, entry of air bubbles, etc. because the recording head is designed to eject ink, pressurized in a pressure generating chamber, as ink droplets from the nozzles toward a recording sheet.

To cope with this, the following function is incorporated. When the nozzle apertures are clogged or an ink cartridge is exchanged, a nozzle formed surface of the recording head is sealed with a capping system. In this state, a suction pump applies a negative pressure to the nozzle formed surface to suck ink from the nozzle apertures. In this way, the clogging in the nozzle apertures or the like due to ink solidification, and ink ejection failure due to the entry of air bubbles into the ink passage are eliminated. This operation is called a cleaning operation.

In performing the cleaning operation, it is effective to generate a fastest possible ink flow within an ink passage, for example, the ink passage ranging from the ink cartridge to the nozzle apertures of the recording head. This also makes it possible to discharge the air bubbles, present in the passage, together with the ink whose viscosity is increased.

In this approach, however, to increase a velocity of the ink in the cleaning operation, the performance of the suction pump must be increased to produce a large negative pressure. This requires the size increase of the pump and the motor for driving the pump, resulting in inevitable increase in cost and size of the entire device.

Further, since a large amount of ink is ejected from the recording head, the lifetime of the ink cartridge is reduced, and the user is compelled to accept an increase of running cost.

To cope with the problem, there is proposed a recording device in JP-A-4-1055, for example. In the proposal, a valve unit operable for opening and closing is located in an ink passage ranging from the ink cartridge to the recording head. In the cleaning operation, the valve unit is put in a closing state, and a negative pressure is applied to the capping system. When a negative pressure increases, the valve unit is opened so that a velocity of the ink flowing within the recording head is instantaneously increased.

In the proposal, there is no need of providing a suction pump specially designed to produce a large negative pressure. Therefore, it is estimated that the ink solidified or increased in its viscosity at positions near the nozzles of the recording head will readily be discharged. Further, the ink is instantaneously sucked from the nozzles. Therefore, it is estimated that the discharging of a relatively small amount of ink will provide a satisfactory cleaning operation.

Many ink jet recording devices as mentioned above are each constructed such that ink cartridges containing black and color ink are detachably attached to the carriage on which the recording head is mounted, from its top. Each ink cartridge is constructed to supply ink to the recording head via a hollow ink supplying needle (referred to frequently as a hollow needle) as an ink introducing portion which is mounted faceup on the carriage.

In the ink jet recording device, the ink passages within the recording head are very fine in structure. Accordingly, the ink to be supplied from the ink cartridge to the recording head must be in such a clean state that foreign matter, e.g., dust, is completely removed from the ink.

If such foreign material as dust is contained in the ink, the clogging problem will arise: the ink passage of the recording head, in particular an extremely thin ink supply port, the nozzle apertures, and the like are clogged with the foreign material. Where the clogging problem arises, the recording head cannot perform a proper ink ejecting operation. In most cases, it is impossible to restore the function of the recording head.

To solve the clogging problem, it is a common practice that a filter for filtering out foreign materials is located at a position upstream of the recording head in the ink passage, e.g., between the hollow needle and the head case for supporting the needle, thereby preventing foreign matters from flowing to the head side.

FIG. 1 shows a structure showing its state. In the figure, reference numeral 21 indicates a hollow needle, which is mounted on the ink cartridge. The hollow needle 21 leads the ink from the ink cartridge storing the ink therein to the recording head. The top end of the hollow needle 21 is sharpened, and its tip is opened to form ink introducing holes 21*a*. The hollow needle 21, which is closely joined to a packing member being made of rubber and mounted on the ink cartridge, introduces the ink from the ink cartridge via the ink introducing holes 21*a*. The base end of the hollow needle 21 radially and downwardly expands, and hence a tapered space 21*b* is formed within the base end.

Another space 20*f* is formed also in a case 20*a* of the recording head on which the base of the hollow needle 21 is mounted. A filter member 22 is placed between the base of the hollow needle 21 and the head case 20*a* that enclose those spaces. An effective area of the filter member 22 is increased by forming the spaces above and below the filter member 22, thereby suppressing a dynamic pressure (pressure loss) of the filter member.

As seen also from the structure shown in FIG. 1, in a state that the ink passage formed in the hollow needle 21 and the filter member 22 are arranged in the gravity direction, an air bubble A, as shown in FIG. 1(A), is left within the tapered space 21*b* which is located within the hollow needle 21 and above the filter member 22, when the ink passage within the recording head is first filled up with ink. Also when the ink cartridge is exchanged with another one, an air bubble A enters the space 21*b* above the filter member 22 and stays within the space 21*b*.

In a case where the printing process is executed in a state that the air bubble A stays and a state of the printing is in a full duty (all the nozzle apertures simultaneously eject droplets at the highest frequency), the air bubble A staying upstream of the filter member 22 slowly moves to a position near the filter member 22, together with the ink flow, and it is put in a state that it balances with the velocity of ink flow.

When the full duty printing further continues, the air bubble A comes in contact with the filter member, a slight part of the air bubble passes through the filter member 22 and reaches the ink passage within the recording head, and it stays in the ink passage within the recording head. When such a state is caused, a phenomenon, called a cushion operation, occurs in which the air bubble absorbs a pressure variation generated in the pressure chamber in accordance with print data. This results in that the recording head fails to eject ink droplets.

The cleaning operation to remove the air bubble as mentioned above is performed. As mentioned above, the negative pressure within the capping system increases, ink flows thereinto from the ink cartridge, and a velocity of the ink flow within the hollow needle 21 is not so high. With this, the air bubble A approximates to or comes in close contact with the filter member 22. However, the air bubble fails to pass through the filter.

Accordingly, in a first mode of the invention, there are provided an ink cartridge which can close an upstream side of the recording head without elongating an ink passage between the recording head and the ink cartridge, in particular, a structure in which a closing system is provided on the ink cartridge, and an ink jet recording device to which the ink cartridge thus constructed is well adaptable.

In a second mode of the invention, a passage control system capable of closing the ink passage or increasing a flow resistance thereof is provided on an ink cartridge, which is located upstream of the filter member at which the air bubbles inevitably stay, whereby a negative pressure is effectively applied to the air bubbles staying on or above the filter member within the hollow needle, and the air bubbles can be allowed to pass through the filter member by instantaneously canceling this. The invention is purposed to provide a structure of an ink cartridge capable of increasing air bubble discharging effects using this, an ink jet recording device to which the ink cartridge can be adopted and a method for controlling the cleaning of a recording head of the recording device.

In a third mode of the invention, similarly, a passage control system capable of closing an ink flow passage is provided on an ink cartridge, and the passage control system is controlled to be open and closed by a pressing force of an ink introducing part of the recording device. The invention is purposed to provide a structure of an ink cartridge producing the effects similar to those mentioned above, an ink jet recording device to which the ink cartridge is well adaptable, and a method for controlling the cleaning of a recording head of the recording device.

DISCLOSURE OF THE INVENTION

In a first mode of the present invention, there is provided an ink cartridge which is detachably mounted to a recording device and supplies ink to a recording head through an ink introducing part provided on the recording device. In the ink cartridge, an ink supply passage, provided on the ink cartridge, for supplying ink to the recording device includes a region capable of closing an ink flow passage.

In this case, the ink cartridge preferably includes a container including an ink storage chamber for storing ink; an ink supply port for supplying ink from the ink storage chamber to the recording head when the ink supply port is coupled to an ink supplying needle communicating with the recording head.

The invention also provides an ink jet recording device to which the ink cartridge of the first mode is well adaptable. An ink supply passage for supplying ink to the recording device includes a region capable of closing an ink flow passage, is detachably mounted to that recording device. The recording device comprises: a member for pressing the region of the ink cartridge; a recording head for executing a printing operation when receiving ink from the ink cartridge; a capping system for sealing the recording head; and a negative pressure generating system for supplying a negative pressure to the capping system.

In this case, an ink supplying needle communicating with the recording head is further provided on the recording device, and the ink cartridge is mounted to the recording device in a state that the ink supply port is coupled to the ink supplying needle.

In the combination of the ink cartridge of the first mode and the ink jet recording device, the ink cartridge includes a region capable of closing the ink flow passage when receiving a pressure from exterior. When a negative pressure is applied to the ink cartridge in a state that the region is closed, a negative pressure is accumulated in the capping system. When the region is opened, a strong negative pressure instantaneously acts on the ink cartridge. As a result, a strong ink flow is caused in the recording head. And, the air bubbles staying there move and are discharged to the capping system on the ink flow caused by the continuously acting negative pressure from the negative pressure generating system.

According to another aspect, there is provided an ink cartridge of a second mode. The ink cartridge is detachably mounted to a recording device and supplies ink to a recording head through an ink introducing part provided on the recording device. In the ink cartridge, a passage control system is located in an ink flow passage formed from an ink storage chamber for storing ink to the ink supply port, and the passage control system closes the ink flow passage or increases flow resistance of the ink flow passage by receiving a drive force from an actuator.

In this case, a packing member is preferably disposed in the ink supply port formed in the ink cartridge to be coupled to the ink introducing part in a state that the ink cartridge is mounted to the recording device.

The passage control system forms a passage opening/closing system capable of opening and closing the ink flow passage by receiving a drive force from the actuator.

The passage control system forms a passage varying system capable of varying flow resistance of the ink flow passage by receiving a drive force from the actuator.

The passage control system includes a sealing member formed of an elastic material which is deformed by receiving a drive force of the actuator, and the ink flow passage is closed or its flow resistance is varied by deformation of the sealing member.

In this case, in a preferred embodiment, the actuator is disposed on the recording device, and the passage control system receives a drive force from the actuator in a state that the ink cartridge is mounted to the recording device. In another predetermined embodiment, the actuator is installed in the ink cartridge.

Any of the ink cartridges mentioned above may be an ink cartridge provided with a plurality of ink storage chambers independently storing ink of plural colors, the ink flow passages are formed respectively from the ink storage chambers to the ink supply ports, and the passage control system is individually located in each ink flow passage to close each ink flow passage or increase flow resistance thereof by receiving a drive force received from a respective actuator.

It is preferable that the passage control system opens the ink flow passage in a state that the passage control system does not receive a drive force from the actuator. The actuator preferably is constructed by an electromagnetic drive mechanism. The actuator may is constructed by a cam mechanism.

In the ink cartridge, it is preferable that an ink degassed to 5 ppm or lower is stored into the ink storage chamber. Further, when the ink cartridge is in a storage state, the ink cartridge is preferably packed in a reduced pressure state by a packing member having a gas barrier property. Furthermore, the ink cartridge is packed in a reduced pressure state by a packing member having a gas barrier property in a state that the passage control system is covered by a cover member.

In the ink cartridge of the second mode, the passage control system is located an ink flow passage formed from an ink storage chamber for storing ink to the ink supply port, and the passage control system closes the ink flow passage or increases passage resistance of the ink flow passage in response to a drive force received from an actuator. Accordingly, the actuator located on the recording device or the ink cartridge causes the passage control system located on the ink cartridge to opening/closing the ink flow passage or to vary passage resistance to the ink flow passage.

Thus, the passage control system is located on a position, which is located closer to the ink cartridge or upstream of the filter at which air bubbles stay. Accordingly, a negative pressure is effectively applied to the air bubbles staying on the filter within the hollow needle. As a result, an external pressure is exerted on the air bubbles stagnant within the hollow needle. Subsequently, the passage control system is operated, by the actuator, to instantaneously remove the negative pressure, whereby the air bubbles are efficiently discharged.

According to another aspect of the invention, there is provided an ink jet recording device to which any of the ink cartridge of the second mode is well adaptable. This recording device has an ink jet recording head for ejecting ink droplets from nozzle apertures in accordance with print data, a capping system for sealingly covering a nozzle forming surface of the recording head and sucking ink from the nozzle apertures by a negative pressure applied from a negative pressure generating system, and an ink introducing part coupled to an ink supply port of an ink cartridge to supply ink from the ink cartridge to the recording head. The ink jet recording device is characterized by a control system for applying a control signal to the actuator in a state that the nozzle forming surface of the recording head is sealed with the capping system, and a negative pressure generated by the negative pressure generating system is applied to and accumulated in the capping system, and a passage control system provided to the ink cartridge is opened or reduced in its flow resistance in accordance with the control signal applied from the control system to the actuator.

In the recording device, the ink cartridge is mounted on a carriage such that an ink flow direction of the ink flow passage formed in the ink cartridge is substantially orthogonal to a moving direction of the carriage.

In the ink jet recording device, an operation to cause the passage control system provided to the ink cartridge to be opened or to be reduced in its flow resistance in the state that the nozzle forming surface of the recording head is sealed with the capping system, and the negative pressure generated by the negative pressure generating system is applied to and accumulated in the capping system, is carried out at the time of initial filling operation in which the recording head is filled with ink.

Also in the ink jet recording device, an operation to cause the passage control system provided to the ink cartridge to be opened or to be reduced in its flow resistance in the state that the nozzle forming surface of the recording head is sealed with the capping system, and the negative pressure generated by the negative pressure generating system is applied to and accumulated in the capping system, is carried out when a restoring command given by a user is issued again within a predetermined amount of printing.

Also in the ink jet recording device, wherein a plurality of ink cartridges having ink storage chambers respectively containing ink of different colors are mounted, and control signals are individually applied to respective actuators for driving the respective passage control system provided on the ink cartridges.

Also in the ink jet recording device, a plurality of ink cartridges including at least an ink cartridge having ink storage chambers respectively containing ink of different colors are mounted, and control signals are individually applied to respective actuators for driving the respective passage control system provided on the ink cartridges.

In this case, the actuator is provided on the recording device, and the actuator is preferably constructed by an electromagnetic drive mechanism. The actuator may be constructed by a cam mechanism.

The ink jet recording device preferably includes an ink end detecting system for detecting an ink end of the ink cartridge mounted. In this case, at least in a state that the negative pressure is applied from the negative pressure generating system to the capping system, the passage control system located in an ink flow passage the ink end of which is detected is kept in a closing state.

In this case, software ink end detecting system for judging the ink end state by at least counting the number of ink droplets ejected from the recording head, or hardware ink end detecting system for judging the ink end by detecting a physical variation in the ink storage chamber sealingly storing ink may be utilized for the ink end detecting system.

During a printing operation, the passage control system located in the ink flow passage the ink end of which is detected is kept in the closing state, and other ink not in an ink end state is used.

In this case, of the other ink not in the ink end state, ink the remaining amount of which is the largest is used for with the exception of tallow ink to execute the printing operation.

Further, when the printing operation is executed using the other ink not in the ink end state, a utility of a print driver installed in a host computer notifies that the printing is to be performed using the other ink not in the ink end state.

When the printing operation is executed using the other ink not in the ink end state, a utility of a print driver installed in a host computer gives a notification to confirm whether or not the printing is to be performed using the other ink not in the ink end state.

In the recording device, the ink introducing part connected to the ink supply port of the ink cartridge is preferably a hollowed ink supplying needle with an ink introducing hole formed at a part of the ink supplying needle.

In a recording head cleaning control method in an ink jet recording device combined with the ink cartridge of the second mode, the recording device has an ink jet recording head for ejecting ink droplets from nozzle apertures in accordance with print data, a capping system for sealingly covering a nozzle forming surface of the recording head and sucking ink from the nozzle apertures by a negative pressure applied from a negative pressure generating system, and an ink introducing part mounted to an ink supply port of an ink cartridge to supply ink from the ink cartridge to the recording head. The cleaning control method comprises: a negative pressure accumulating step in which a negative pressure is applied from the negative pressure generating system to and accumulated in the capping system in a state that the nozzle forming surface of the recording head is sealed with the capping system, and the passage control system provided to the ink cartridge is closed or to be increased in flow resistance; and a negative pressure releasing step in which the passage control system provided to the ink cartridge is opened or decreased in flow resistance in a state that the negative pressure is accumulated in the capping system.

In this case, each of the negative pressure accumulating step and the negative pressure releasing step is executed by the respective passage control system, concurrently.

Each of the negative pressure accumulating step and the negative pressure releasing step may be executed by specific one of the passage control system.

In the cleaning control method, the negative pressure releasing step may be executed by specific one of the passage control system.

In this case, the negative pressure releasing step by the specific one the passage control system is executed, by a control program installed in the recording device, for an ink flow passage filled with ink whose color density is high.

Further, the negative pressure releasing step is executed depending on a left standing time after the printing operation of the recording device previously ends.

The negative pressure releasing step executed by the specific one of the passage control system is preferably executed based on designation information set on a utility of a print driver installed in a host computer or set on the recording device.

In the ink jet recording device employing the cleaning control method, the passage control system located in the ink flow passage of the ink cartridge is driven in synchronism with the cleaning operation for sucking ink droplets from the nozzle apertures by the capping system, thereby closing the ink flow passage or increasing its flow resistance.

In this state, the suction pump as the negative pressure generating system is driven, and a control sequence in which the passage control system of the ink cartridge is operated for valve opening in a state that the negative pressure is accumulated in the capping system.

Through the execution of the control sequence, in particular air bubble staying on the filter member within the ink supplying needle is expanded by the negative pressure. In this state, the negative pressure is instantaneously released at an upstream position of the ink supplying needle, the air bubbles on the filter member within the needle are effectively discharged to the capping system on a initial ink flow.

In this case, other air bubble than those staying within the ink supplying needle, e.g., air bubble stating at stagnant parts in the ink flow passage of the recording head is effectively discharged to the capping system.

Also in the ink cartridges or one ink cartridge, the passage control system installed to, for example, the color ink cartridges for storing different color inks may be controlled concurrently or individually.

Accordingly, when the cleaning control method for individually controlling the passage control system corresponding to the ink cartridges containing specific one of inks is employed, the cleaning operation is efficiently controlled corresponding to the specific ink.

As known, where an ink whose colorant concentration is high, e.g., black ink, is used, the restoring of the ink ejecting function by the cleaning operation is slow when comparing with other color inks.

Accordingly, where the operation sequence mentioned above is used, the nozzles ejecting the color inks first resumes their normal ejecting function frequently. In this case, only color inks are discharged in large amount into the capping system, and wasted, and a negative pressure fails to act on the nozzles ejecting the black ink.

For this reason, if only the passage control system corresponding to the black ink is operated for valve opening in the negative pressure removing step, the ink can be discharged from the nozzle apertures ejecting the black ink, and an efficient cleaning operation is performed while suppressing the waste of ink.

To achieve the above object, there is provided an ink cartridge of a third mode. The ink cartridge is detachably attached to a recording device and supplies ink to a recording head through an ink introducing part provided on the recording device, and comprises a passage control system located in an ink supply port formed in the ink cartridge, the passage control system being operated for valve opening by receiving a pressing force from ink introducing part of the recording device in a state that the ink cartridge is mounted to the recording device, whereby ink can be supplied from an ink storage chamber to the recording head, wherein the passage control system is operated for valve closing by receiving a further pressing force from the ink introducing part of the recording device, thereby stopping supply of ink from the ink storage chamber.

In this case, the passage control system is adapted to move within the ink supply port by being pressed by the ink introducing part of the recording device so that the passage control system disengages from a first packing member located in the ink supply port by receiving the pressing force from the ink introducing part of the recording device to be placed to a valve opening state, and engages with a second packing member located in the ink supply port by receiving the further pressing force from the ink introducing part of the recording device.

The passage control system is preferably urged by a spring member to engage with the first packing member.

In a preferred embodiment, the passage control system includes a disc like member, when a first surface of the disc like member engages the first packing member, the passage control system is placed to the valve closing state, when the disk like member is located at a mid position between the first and second packing members, the passage control system is placed to a valve opening state, and when a second surface of the disc like member engages the second packing member, the passage control system is placed to the valve closing state.

Preferably, the passage control system includes the disc like member and a shaft member for guiding movement of the disc like member, and the passage control system is disposed in the ink supply port so that the disc like member is moved in an axial direction of the shaft member.

Preferably, the first packing member is brought into engagement with the ink introducing part of the recording device, whereby the first packing member is kept in a liquid tight state with the ink supply port of the ink cartridge.

In this case, in a preferred embodiment, the first packing member includes a hollow member, the ink introducing part of the recording device includes a hollow ink supplying needle, and the ink supplying needle of the recording device engages with an inner circumferential surface of the hollow member.

In the thus constructed ink cartridge of the third mode, in a state that it is loaded to the recording device, it receives a pressing force from the ink introducing part of the recording device, the passage control system of the ink supply port is operated for valve opening. As a result, ink is supplied from the ink cartridge to the recording device.

When receiving a further pressing force from the ink introducing part of the recording device, the passage control system operates for valve closing. As will be described later, in cleaning the recording head, the negative pressure is effectively accumulated in the inner space of the capping system.

Additionally, the passage control system is located at an upstream position of the filter member at which the air bubbles necessarily stays. Accordingly, the negative pressure is effectively applied to the air bubbles stagnating on the filter member within the ink supplying needle. As a result, an external pressure may be applied to expand the air bubbles stagnating within the ink supplying needle. Subsequently, the passage control system is operated to instantaneously remove the negative pressure, so that the air bubbles are efficiently discharged.

When the above ink cartridge is not attached to the recording device, the ink cartridge, the ink supply port is placed to a valve closing state by the passage control system located in the ink supply port. Accordingly, even when it is detached from the recording device during its use, there is no chance that ink leaks from the ink cartridge or air enters the ink cartridge. Therefore, the ink cartridge may be attached to the recording device and used again.

According to the present invention, there is provided an ink jet recording device to which the ink cartridge of the third mode is adapted. The ink jet recording device has an ink jet recording head for ejecting ink droplets from nozzle apertures in accordance with print data, a capping system for sealingly covering a nozzle forming surface of the recording head and sucking ink from the nozzle apertures by a negative pressure applied from a negative pressure generating system, and an ink introducing part coupled to an ink supply port of an ink cartridge to supply ink from the ink cartridge to the recording head. The ink cartridge comprises an actuator for varying a position of the ink supply port of the ink cartridge attached to the recording device relative to the ink introducing part of the recording device to control an opening/closing valve of the passage control system of the ink cartridge, wherein a negative pressure is applied to the capping system sealing the nozzle forming surface of the recording head in a state that the passage control system is put in a valve closing state, and wherein the passage control system is operated for valve opening by driving the actuator in a state that the negative pressure is accumulated in the capping system.

In this case, the actuator includes an eccentric cam mechanism. Preferably, the actuator is located at the bottom of a cartridge holder to which the ink cartridge is detachably mounted, and an urging system is located in the cartridge holder for urging the mounted ink cartridge toward the actuator.

Preferably, the urging system for urging the ink cartridge toward the actuator includes a spring member located on a reverse side of a lid for closing an upper part opening of the ink cartridge.

Additionally, in the recording device, an operation in which the passage control system is operated for valve opening by driving the actuator in the state that the negative pressure is accumulated is performed during an initial ink filling operation in which the recording device is initially filled with ink.

In the ink jet recording device, an operation in which the passage control system is operated for valve opening by driving the actuator in a state that the negative pressure is accumulated may be performed when a restoring operation command issued by a user again within a predetermined printing quantity.

According to the invention, there is provided a recording head cleaning control method for an ink jet recording device, which is used in combination with the ink cartridge of the third mode. The recording device has an ink jet recording head for ejecting ink droplets from nozzle apertures in accordance with print data, a capping system for sealingly covering a nozzle forming surface of the recording head and sucking ink from the nozzle apertures by a negative pressure applied from a negative pressure generating system, and an ink introducing part coupled to an ink supply port of an ink cartridge to supply ink from the ink cartridge to the recording head. The cleaning control method comprises: a valve-closing control step of controlling the passage control system of the ink cartridge for valve closing by varying a position of the ink supply port of the ink cartridge mounted to the recording device relative to the ink introducing part of the recording device; a negative pressure accumulating step for applying a negative pressure from the negative pressure generating system to the inside of the capping system sealing the nozzle forming surface of the recording head, thereby accumulating the negative pressure therein; and a negative pressure releasing step of releasing the negative pressure in a manner that the passage control system of the ink cartridge is operated for valve opening by driving the actuator in a state that the negative pressure is accumulated in the capping system.

In this case, each of the negative pressure accumulating step and the negative pressure releasing step is executed concurrently for a plurality of the ink cartridges, concurrently.

Each of the negative pressure accumulating step and the negative pressure releasing step may be executed for a specific one of the specific ink cartridges.

Further, in the cleaning control method, the negative pressure releasing step may be executed for a specific one of the specific ink cartridges.

In this case, the negative pressure releasing step for the specific one of the ink cartridges is executed, by a program installed in the recording device, for an ink cartridge storing ink whose coloring density is high.

Further, in the cleaning control method, the negative pressure releasing step may be executed depending on a left standing time after printing operation of the recording device previously ends.

The negative pressure releasing step executed for the specific ink cartridge may be executed based on designation information set on a utility of a print driver installed in a host computer or set on the recording device.

In the ink jet recording device employing the cleaning control method, a position of the ink supply port of the ink cartridge loaded to the recording device relative to the ink introducing part of the recording device is varied in synchronism with a cleaning operation in which ink droplet from the nozzle apertures are sucked by the capping system, and the passage control system of the ink cartridge is operated for valve closing.

In this state, the suction pump as the negative pressure generating system is driven, so that a negative pressure is accumulated in the capping system which sealingly covers the nozzle forming surface of the recording head.

Then, the following sequence is executed. The actuator is driven again in a state that a negative pressure is stored in the capping system, to thereby vary a position of the ink supply port of the ink cartridge relative to the ink introducing part of the recording device. And the passage control system of the ink cartridge is operated for valve opening.

Through the execution of the control sequence, in particular air bubbles A1 staying on the filter member within the ink supplying needle is expanded by the negative pressure. In this state, the negative pressure is instantaneously removed at an upstream position of the ink supplying needle, the air bubbles on the filter member within the needle are effectively discharged to the capping system 9 on a fast ink flow.

In this case, other air bubbles than those stagnating within the ink supplying needle, e.g., air bubbles stagnating at stagnant parts in the ink flow passage of the recording head is effectively discharged to the capping system.

In the construction where actuators being able to varying a position of the ink supply port of the ink cartridge relative to the ink introducing part of the recording device are set to the loading positions of the ink cartridges, and the passage control system of the ink cartridges are individually controlled, the negative pressure removing step may be executed for each ink cartridge. Where the construction is used, the cleaning operation may be efficiently executed corresponding to a specific ink.

As known, where an ink whose colorant concentration is high, e.g., black ink, is used, the restoring of the ink ejecting function by the cleaning operation is slow when comparing with other color inks. Accordingly, where the operation sequence mentioned above is used, the nozzles ejecting the color inks first resumes their normal ejecting function frequently. In this case, only color inks are discharged in large amount into the capping system, and wasted, and a negative pressure fails to act on the nozzles ejecting the black ink. For this reason, if only the passage control system corresponding to the black ink is operated for valve opening in the negative pressure removing step, the ink can be discharged from the nozzle apertures ejecting the black ink, and an efficient cleaning operation is performed while suppressing the waste of ink.

The present disclosure relates to the subject matter contained in Japanese patent application Nos. 2000-009205 (filed on Jan. 8, 2000), 2000-252474 (filed on Aug. 23, 2000) and 2000-260590 (filed on Aug. 30, 2000), which are expressly incorporated herein by reference in their entireties.

BEST MODES FOR CARRYING OUT THE INVENTION

Figure 2:
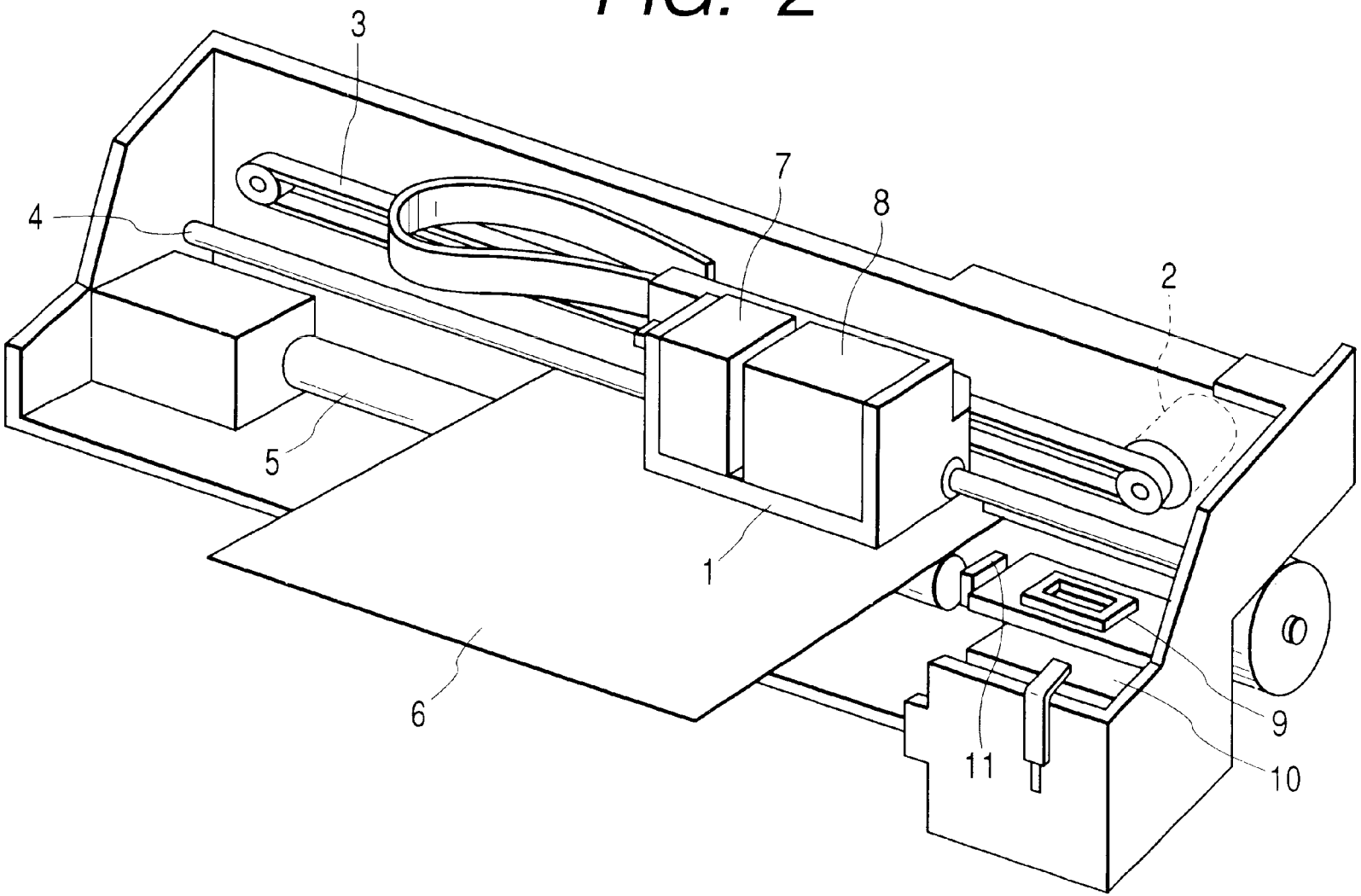
FIG. 2 is a perspective view showing a basic construction of an ink jet recording device constructed according to the present invention.

FIG. 2 is a perspective view showing a basic construction of an ink jet recording device which utilizes an ink cartridge of each of first to third modes of the invention, which will be described hereunder. Reference numeral 1 designates a carriage. The carriage 1 is guided by a guide member 4 and is reciprocatively moved in an axial direction of a platen 5 via a timing belt 3 driven by a carriage motor 2.

A recording head to be described later is mounted on a surface (lower surface) of the carriage 1, which faces a recording sheet 6, and a black ink cartridge 7 and a color ink cartridge 8, which supply ink to the recording head, are detachably mounted on the upper side of the carriage.

Reference numeral 9 is a capping system disposed in a non-print region (home position). When the recording head moves to a position just above the capping system 9, the capping system is raised to sealingly cover a nozzle forming surface of the recording head. A suction pump 10 serving as a negative pressure generating system for applying a negative pressure to the inner space of the capping system 9 is disposed under the capping system 9.

The capping system 9 functions as a lid for preventing nozzle apertures of the recording head from drying during a rest time of the recording device, as an ink reception in a flushing mode in which a drive signal irrelevant to the printing is applied to the recording head so that the ink droplets are idly ejected, and as a cleaning system which applies a negative pressure of the suction pump 10 to the recording head to suckingly discharge ink from the nozzle apertures of the recording head.

A wiping member 11 formed with an elastic plate made of rubber or the like is disposed adjacent to the side of the capping system 9 which is closer to a print region, in a state that it is movable in a horizontal direction. The wiping member 11, upon occasion, advances to the moving path of the recording head, and wipes the nozzle forming surface of the recording head after the suction pump 10 sucks the ink.

Figure 3:
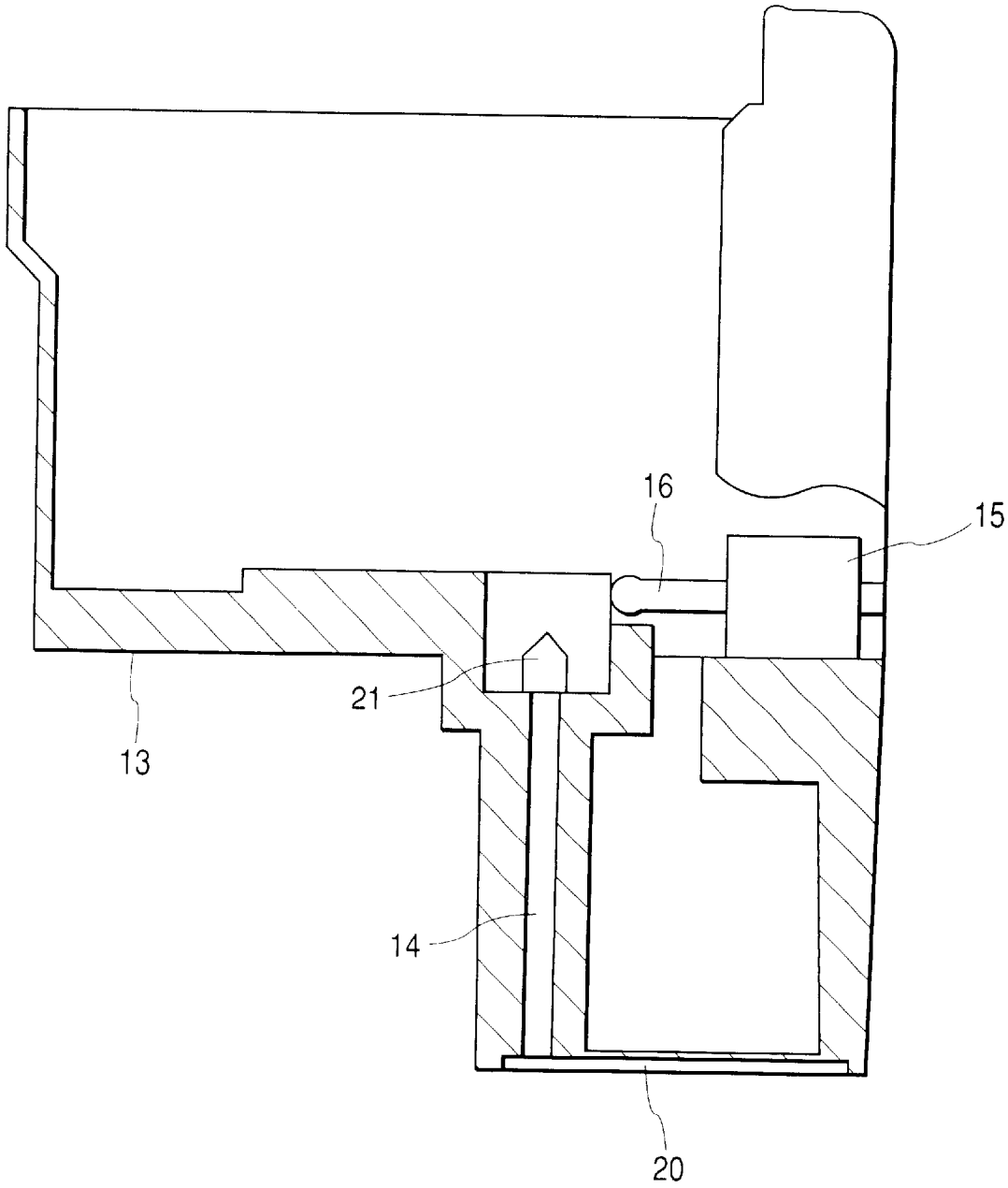
FIG. 3 is a cross sectional view showing a cartridge holder to which an ink cartridge of a first mode of the invention is loaded.

FIG. 3 shows a construction of a cartridge holder in the recording device using an ink cartridge which forms a first mode of the invention. The cartridge holder 13 is arranged within the carriage 1. An ink supplying needle 21 as an ink introducing part which is to be inserted into an ink supply port of the ink cartridge of the first mode to be described later, is planted in the other end of an ink introducing passage 14 whose one end communicates with a recording head 20. An operating rod 16 driven by a solenoid 15 is disposed at a position not facing the hollow needle 21, while extending to a direction intersecting the axis of the hollow needle 21.

Figure 4:
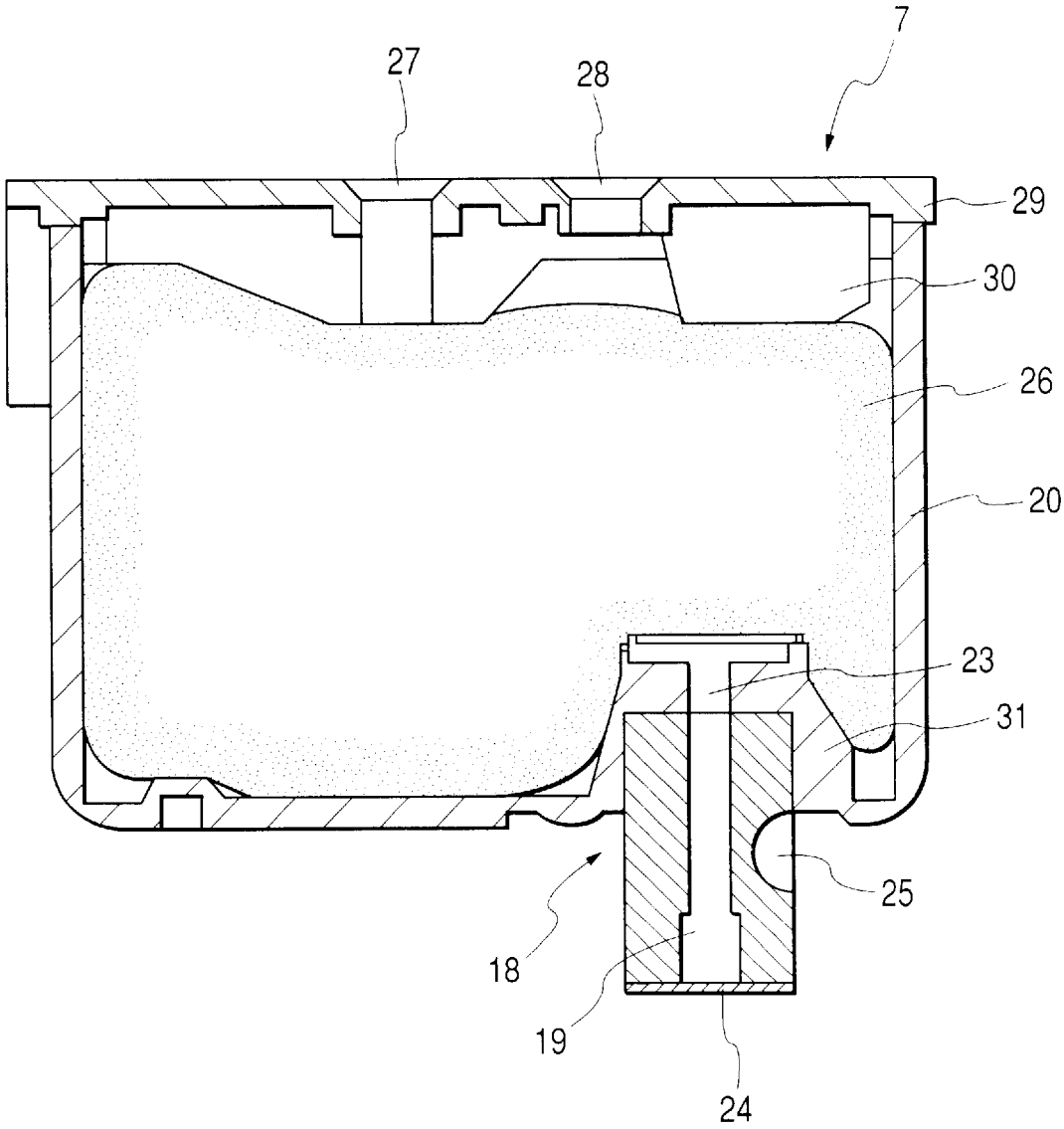
FIG. 4 is a cross sectional view showing an ink cartridge of a first mode of the invention, which is to be loaded to the FIG. 3 cartridge holder.

FIG. 4 is a cross sectional view showing the ink cartridge as the first mode of the invention, which is mounted to the cartridge holder shown in FIG. 3. The ink cartridge takes the form of the black ink cartridge 7, by way of example.

An ink supply port 18, which comes in engagement with the hollow needle 21, is formed in the lower part of a container 20 forming an ink storing chamber in its interior. The ink supply port 18, tubular in shape, is made of an elastic material, such as rubber, so that at least a region of the ink supply port facing the operating rod 16 is elastically deformable, and includes an ink flow passage 19. The ink supply port 18 is fixed at one end to the container 20 so that one end of the ink flow passage 19 communicates with an ink discharging port 23. A sealing film 24 which can be pierced by the hollow needle 21 to pass therethrough is stuck to the lower end of the ink supply port. In the embodiment, a recess 25 which serves as a guide for the operating rod 16 and defines a deformable region is formed at a region of the ink supply port which faces the operating rod 16.

The container 20 contains a porous member 26 impregnated with ink, and an opening of the container is sealingly covered with a lid 29 having an ink injection port 27 and an air communicating port 28. The porous member 26 is put in elastic contact with a protruded part 31, protruded inward from the ink supply port, by means of the lib 30, whereby a capillary force of a part of the porous material 26, which is located in the vicinity of the ink supply port, is increased and the ink discharging to the ink supply port 18 is facilitated.

Figure 5:
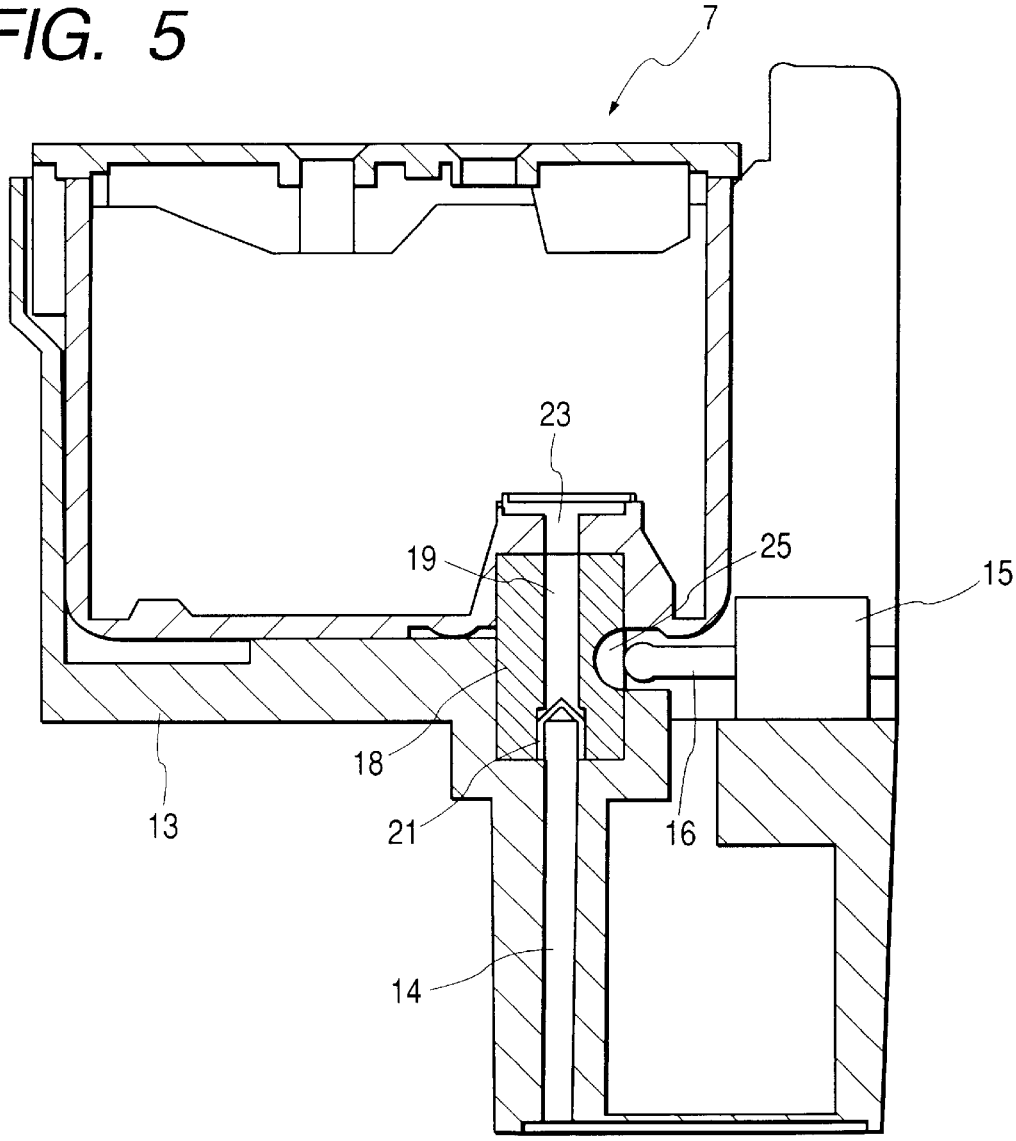
FIG. 5 is a cross sectional view showing a state that the FIG. 4 cartridge is loaded to the cartridge holder and the supplying of ink to the recording head is allowed.

In the embodiment, when the cartridge 7 is loaded into the cartridge holder 8 shown in FIG. 3, the ink supply needle 21, as shown in FIG. 5, penetrates through the sealing film 24 and hermetically engages with the ink supply port 18, and the operating rod 16 faces the readily deformable region, i.e. the recess 25, of the ink supply port 18.

In this state, the carriage 1 is moved to a position of the capping system 9, the nozzle forming surface of the recording head 20 is sealed with the capping system 9, and the suction pump 10 is operated. Ink is pulled out of the ink cartridge under a negative pressure effected from the recording head 20 to flow into the recording head 20 via the ink supply port 18.

Along the ink flow, air bubbles staying in the recording head 20 and other passages are discharged by the capping system 9, so that the recording head 20 is ready for printing.

In a case where printing failure occurs during the printing operation, and it is necessary to restore the ink droplet ejecting function, the carriage 1 is moved to the position of the capping system 9 as in the previous case, and the recording head 20 is sealed with the capping system.

Figure 6:
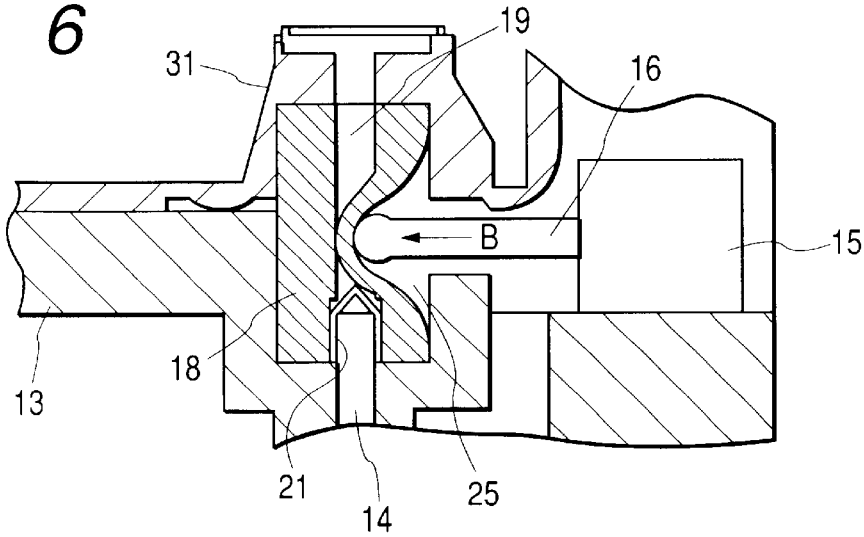
FIG. 6 is an enlarged, cross sectional view showing an ink supply port being closed and its vicinity.

Then, a control system (not shown) outputs a signal to the solenoid 15 to energize the same, so that the operating rod 16, as shown FIG. 6, protrudes to the ink supply port as shown by arrow B and elastically presses the ink supply port 18 to close the ink flow passage 19.

In this state, the suction pump 10 is operated. In this case, since the upstream side, or the ink cartridge side, is closed, a negative pressure accumulatively increases in the capping system 9 and a strong negative pressure acts on the recording head 20. After a predetermined time elapses, the solenoid 15 is deenergized, to retract the operating rod 16 to thereby open the ink flow passage 19.

As a result, a strong negative pressure instantaneously acts on the ink cartridge, and a strong ink flow occurs in the recording head 20. And, the air bubbles staying there begin to move and are discharged to the capping system 9 along with the ink flow caused by the continuously acting negative pressure from the suction pump.

In the embodiment, the ink flow passage between the ink supply needle 21 and the ink supply port of the ink cartridge is closed. Therefore, the ink consumption is reduced and a negative pressure is rapidly increased.

It is noted that the ink supply port forming a valve mechanism is included in the ink cartridge, i.e. a supply part. Accordingly, every time that the ink cartridge is exchanged with a new one, the ink supply port forming a valve mechanism is also exchanged with a new one, and hence a high reliability can be secured.

In the above-mentioned embodiment, the ink flow passage is closed by the solenoid. If required, a displacing member rotated by a motor may be used to close the ink flow passage. Also in the embodiment, the porous member impregnated with ink is contained in the container. If required, the container may be formed as a liquid chamber in which ink is directly contained in the container.

In the first mode of the present invention, the recess 25, i.e. a closeable region, and a driving system for closing the closeable region have been described with reference to the black ink cartridge 7. In case of the color ink cartridge 8 having a plurality of ink supply ports respectively communicating ink storage chambers, such a closeable region is provided to each of the ink supply ports, and also the driving systems are provided to be capable of selectively closing the respective closeable regions. In case where such black and color ink cartridges are mounted to the recording device, the driving systems may be operated to simultaneously close (or open) all of the closeable regions, or may be operated to independently close (or open) the closeable regions in an ink supply port by ink supply port basis, or in an ink cartridge by ink cartridge basis, as described latter.

As described above, in the ink cartridge of the first mode and the recording device, a region being able to close the ink flow passage by a pressure received from exterior is included in the ink supply port for supplying ink to the recording device. Accordingly, when the ink supply port is closed and the suction pump is driven, a negative pressure is accumulatively increased in the capping system. Subsequently, the ink supply port is opened, so that a strong ink flow is generated in the recording head and air bubbles staying there are readily removed.

Further, the ink supply port forming a valve mechanism is included in the ink cartridge i.e. a supply part. Accordingly, every time that the ink cartridge is exchanged with a new one, the ink supply port forming a valve mechanism is also exchanged with a new one, and hence a high reliability is secured when the cleaning operation in which the negative pressure is accumulated is reliably performed.

Figure 7:
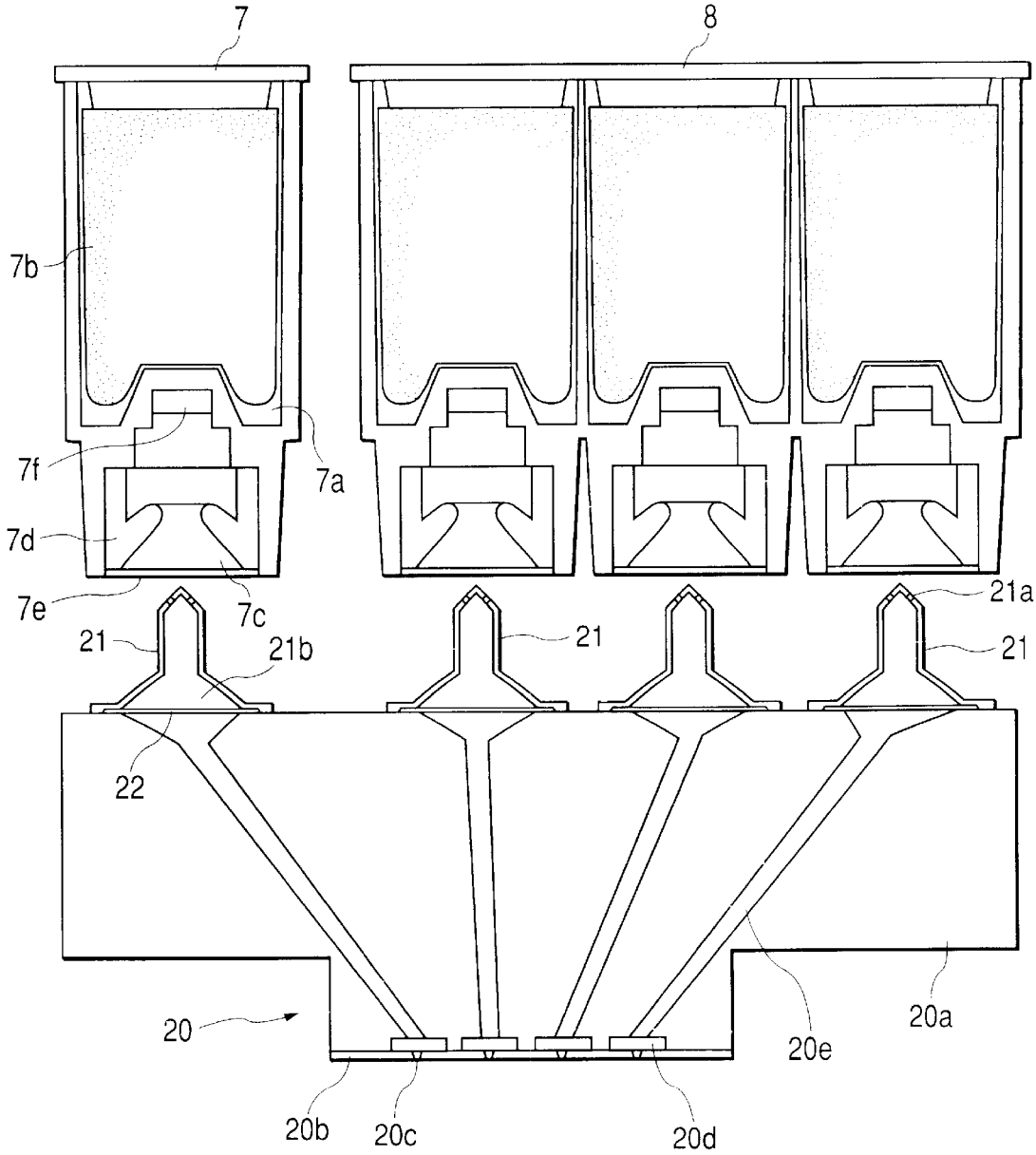
FIG. 7 is a cross sectional view showing ink cartridges of a second mode of the invention and a part of a recording device to which the ink cartridges are loaded.

FIG. 7 is a cross sectional view showing ink cartridges of a second mode of the invention and a part of a recording device to which the ink cartridges are loaded. As shown FIG. 7, a nozzle plate 20*b* forming a nozzle forming surface of a recording head 20 is disposed on the lower surface of a head case 20*a* forming the recording head 20. A plurality of nozzle apertures 20*c* are formed in the nozzle plate 20*b*.

Pressure chambers are formed corresponding to the nozzle apertures 20*c*, respectively. Actuators 20*d* constructed by piezoelectric vibrators, which are put on the pressure chambers, are disposed within the head case 20*a*. Ink flow passages 20*e*, which extend upward from the nozzle apertures 20*c* and the pressure chambers, are formed in the head case 20*a*.

Four hollow ink supplying needles 21, which form ink introducing parts, stand erect on the upper surface of the head case 20*a*. The ink flow passages 20*e* formed in the head case 20*a* communicate with ink flow passages within the ink supplying needles 21. Ink introducing holes 21*a* are formed at a part of each of the ink supplying needles 21. Ink is introduced from the ink cartridges into the ink supplying needles 21 via the ink introducing holes 21*a*, and then supplied to the pressure chambers of the recording head via the ink flow passages 20*e*.

The ink supplying needle 21 located on the leftmost side in FIG. 7 is provided for receiving black ink, and a black ink cartridge 7 is mounted to the ink supplying needle 21, from above. An ink storage chamber 7*a* occupies most of the upper part of the black ink cartridge 7. A porous member (foam) 7*b* is contained in the ink storage chamber 7*a*. The black ink is stored therein in a state that the porous member 7*b* is impregnated with the black ink.

An ink supplying port 7*c* is formed in the lower part of the ink storage chamber 7*a*. An annular packing member 7*d* made of rubber is fitted to the interior of the ink supplying port 7*c*. A film member 7*e* is sealingly stuck to the lower end of the ink supplying port 7*c* to prevent evaporation of ink solvent during the storage of the ink cartridge.

An ink flow passage 7*f* is formed in the ink cartridge of the second mode shown in FIG. 7, while horizontally extending from the ink storage chamber 7*a* to the ink supplying port 7*c*, as will subsequently be described. A passage control system is located in the mid position of the ink flow passage 7*f*. Accordingly, ink derived from the ink storage chamber 7*a* flows to the ink supplying port 7*c* via the ink flow passage 7*f*.

When the black ink cartridge 7 is pressed to the ink supplying needle 21 while keeping its attitude shown in FIG. 7, the ink supplying needle 21 pierces through the film member 7*e* stuck to the ink supplying port 7*c*. And, the packing member 7*d* disposed within the ink supplying port 7*c* is brought into contact with the circumference of the ink supplying needle 21, and the black ink cartridge 7 is put in a loaded state. In this state, the black ink may be supplied to the recording head.

The color ink cartridge 8 includes ink storage chambers which individually contains respective color ink of cyan, magenta and yellow ordered from the left to the right as shown in FIG. 7. Those storage chambers are integrally formed. Each of those storage chambers is similar in construction to the black ink cartridge 7. Accordingly, the detail of the construction of the storage chamber is not discussed. The color ink cartridge 8 is loaded into the recording head in such a manner that it is pressed to the remaining three ink supplying needles 21 standing erect on the head case 20*a*, while being in an attitude shown in FIG. 7. After loaded, the color ink may be supplied to the recording head via the three ink supplying needles 21.

Figure 8:
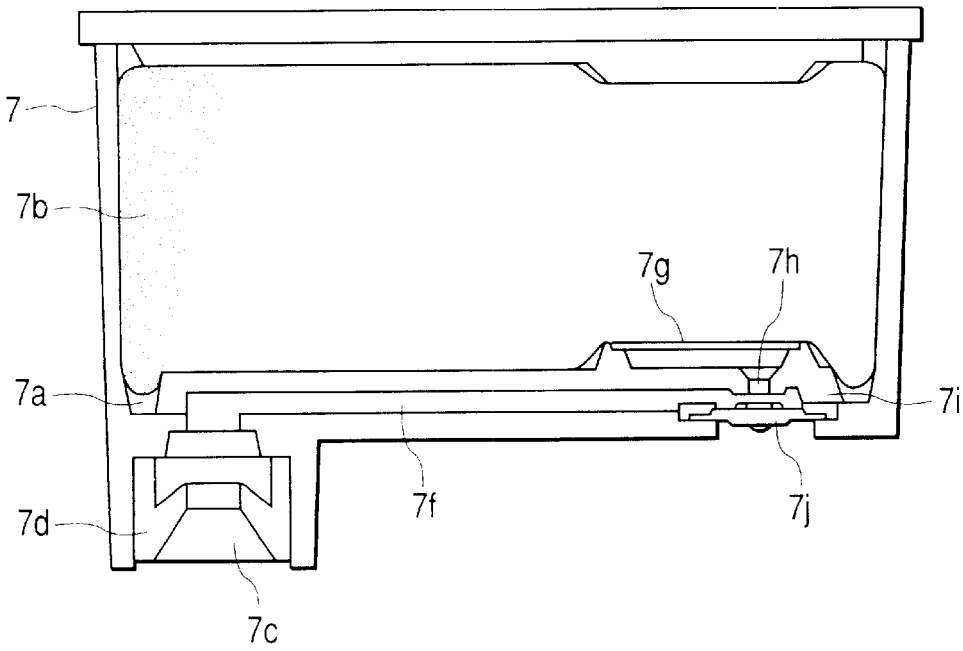
FIG. 8 is a sectional view showing a first embodiment of the ink cartridge of the second mode.

FIG. 8 is a longitudinal sectional view showing a first embodiment of the ink cartridge of the second mode, the view taken on the substantially center line of the ink storage chamber of the ink cartridge. The black ink cartridge 7 is typically used for the ink cartridge shown in FIG. 8. The same thing will be applied to the color ink cartridge. In the figures to be referred to, like or equivalent portions are designated by like reference numerals in the figure already referred to.

A cartridge filter 7*g* is disposed at the exit of the ink storage chamber 7*a*. A valve seat 7*i* with an opening 7*h* is located just below this filter 7*g*. A sealing member 7*j* forming a passage control system is loaded just below the opening 7*h* formed in the valve seat 7*i*. The sealing member 7*j* is shaped like a disc and made of such elastic material as rubber. The sealing member 7*j* receives a drive force, which presses upward the lower side of the sealing member, and thus the substantially central part of the sealing member 7*j* is deformed to close the opening 7*h* of the valve seat 7*i*.

In the illustrated embodiment, the sealing member 7*j* opens the ink flow passage when it does not receive a drive force by an actuator to be described later. The ink derived from the ink storage chamber 7*a* through the opening 7*h* of the valve seat 7*i* is introduced into the ink flow passage 7*f* horizontally formed near the bottom of the ink cartridge, and flows to the ink supplying port 7*c* via the ink flow passage 7*f*.

Figure 9:
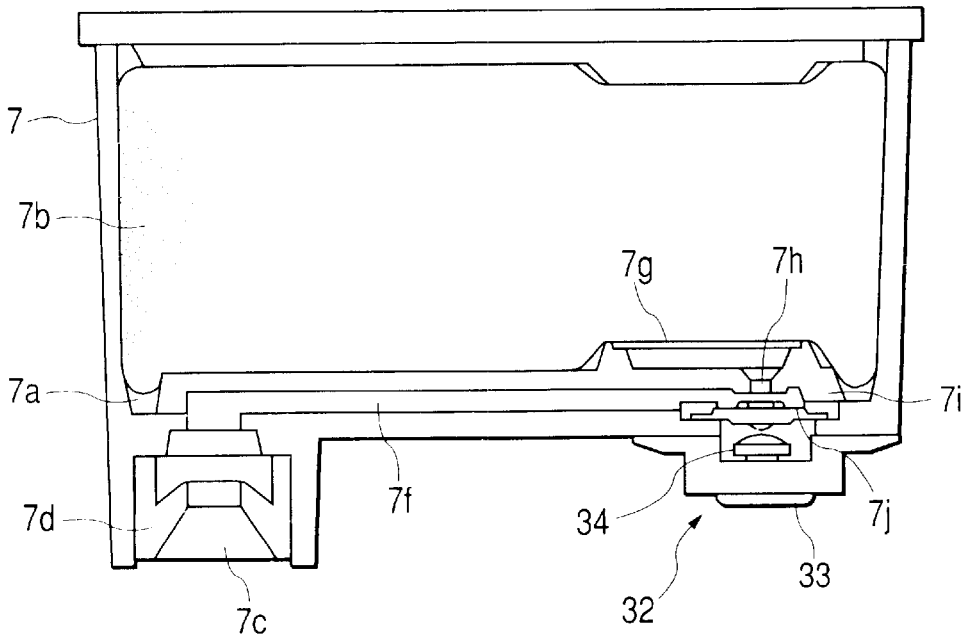
FIG. 9 is a sectional view showing a second embodiment of the ink cartridge of the second mode.

FIG. 9 is a longitudinal sectional view showing a second embodiment of the ink cartridge of the second mode, the view taken on the substantially center line of the ink storage chamber of the ink cartridge. The ink cartridge 7 shown in FIG. 9 is provided with an actuator 32 for producing a drive force to press upward the lower side of the sealing member 7*j*, which constitutes a passage control system. The actuator 32 of the embodiment includes an electromagnetic drive mechanism 33. Specifically, current is fed to the electromagnetic drive mechanism 33 so that an operation piece 34 of the electromagnetic drive mechanism produces a dive force to press upward the sealing member 7*j*.

As a result, the opening 7*h* of the valve seat 7*i* is closed with the sealing member, and hence the ink flow passage 7*f* is closed. When the current feeding to the electromagnetic drive mechanism 33 is stopped, the operation piece 34 of the electromagnetic drive mechanism 33 is returned to its original position by a spring (not shown), as shown in FIG. 9. And, the opening 7*h* of the valve seat 7*i* is opened. In other words, in the embodiment shown in FIG. 9, a passage opening/closing system, i.e., an electromagnetic valve, is formed which is able to open and close the ink flow passage through the feeding and non-feeding of current to the actuator 32.

Figure 10:
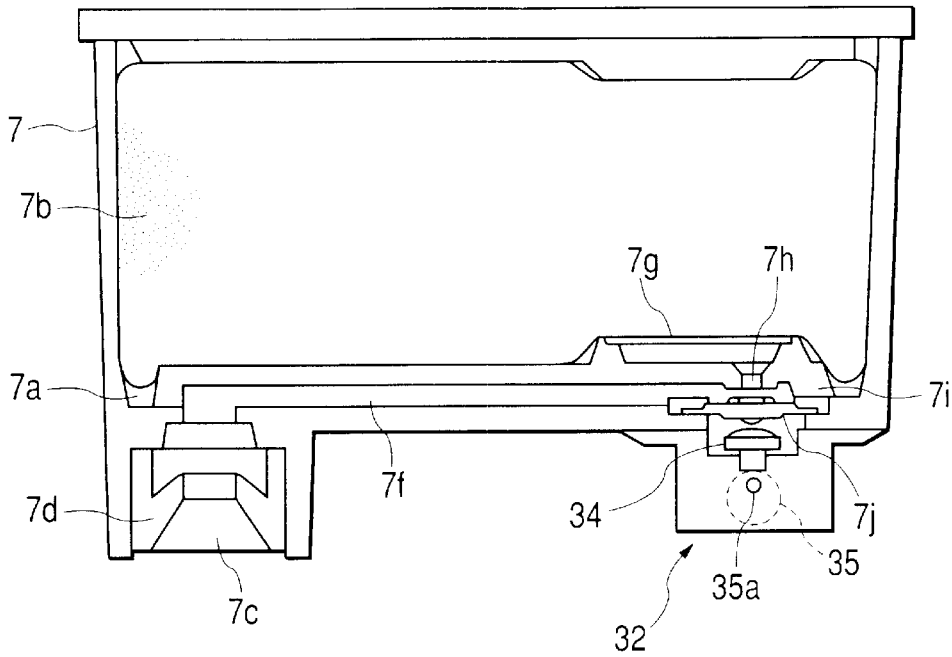
FIG. 10 is a sectional view showing a third embodiment of the ink cartridge of the second mode.

FIG. 10 is a longitudinal sectional view showing a third embodiment of the ink cartridge of the second mode, the view taken on the substantially center line of the ink storage chamber of the ink cartridge.

The ink cartridge 7 shown in FIG. 10 employs a cam mechanism 35 having an eccentric cam as the actuator 32 for generating a drive force to press upward the sealing member 7*j* constituting a passage control system. Accordingly, when the cam mechanism 35 is rotated about a shaft 35*a* thereof, the operation piece 34 presses upward the sealing member 7*j*.

As a result, the opening 7*h* of the valve seat 7*i* is closed, and hence the ink flow passage 7*f* is closed. When the cam mechanism 35 is further turned about the shaft 35*a* by 180° in the same direction or reversely turned, the operation piece 34 is returned to its original position by a spring (not shown) as shown in FIG. 10, and the opening 7*h* of the valve seat 7*i* is opened.

Accordingly, a distance between the sealing member 7*j* as the passage control system and the opening 7*h* formed in the valve seat 7*i* can be adjusted in accordance with an angular position of the cam mechanism 35. This forms flow resistance varying system which varies a flow resistance of the ink flow passage.

The ink cartridge 7 of the second mode shown in any of FIGS. 8 to 10, which has been described above, is provided with one ink storage chamber storing the black ink. Also in the color ink cartridge 8 provided with a plurality of ink storage chambers for individually storing different color ink, a passage control system is provided to each of the ink flow passages 7*f* ranging from the ink storage chambers to the ink supplying ports, to close the associated ink flow passage 7*f* or increases passage resistance of the associated ink flow passage 7*f* upon individually receiving a drive force from the associated actuator.

Each ink cartridge of the second mode of the invention thus far described employs a relatively complicated structure to guide ink from the ink storage chamber 7*a* to the ink supplying port 7*c*, through the valve seat 7*i* forming the passage control system, the sealing member 7*j*, and the ink flow passage 7*f* horizontally extending in the bottom part of the cartridge. Accordingly, air bubbles are likely to be left at stagnant places formed at some of the component parts of the ink cartridge.

To cope with this, it is desirable to use ink having a high degassed rate for the ink to be stored in the ink cartridge. In this connection, it was discovered that when ink degassed to 5 ppm or lower was sealingly stored in the ink cartridge, air bubbles generated at the stagnant places of the component parts of the ink cartridge were effectively dissolved into ink solvent.

When the ink cartridge is shipped from a factory, or when the ink cartridge is in a storage state, it is effective to pack the ink cartridge in a reduced pressure state by a packing member having a gas barrier property.

Figure 12:
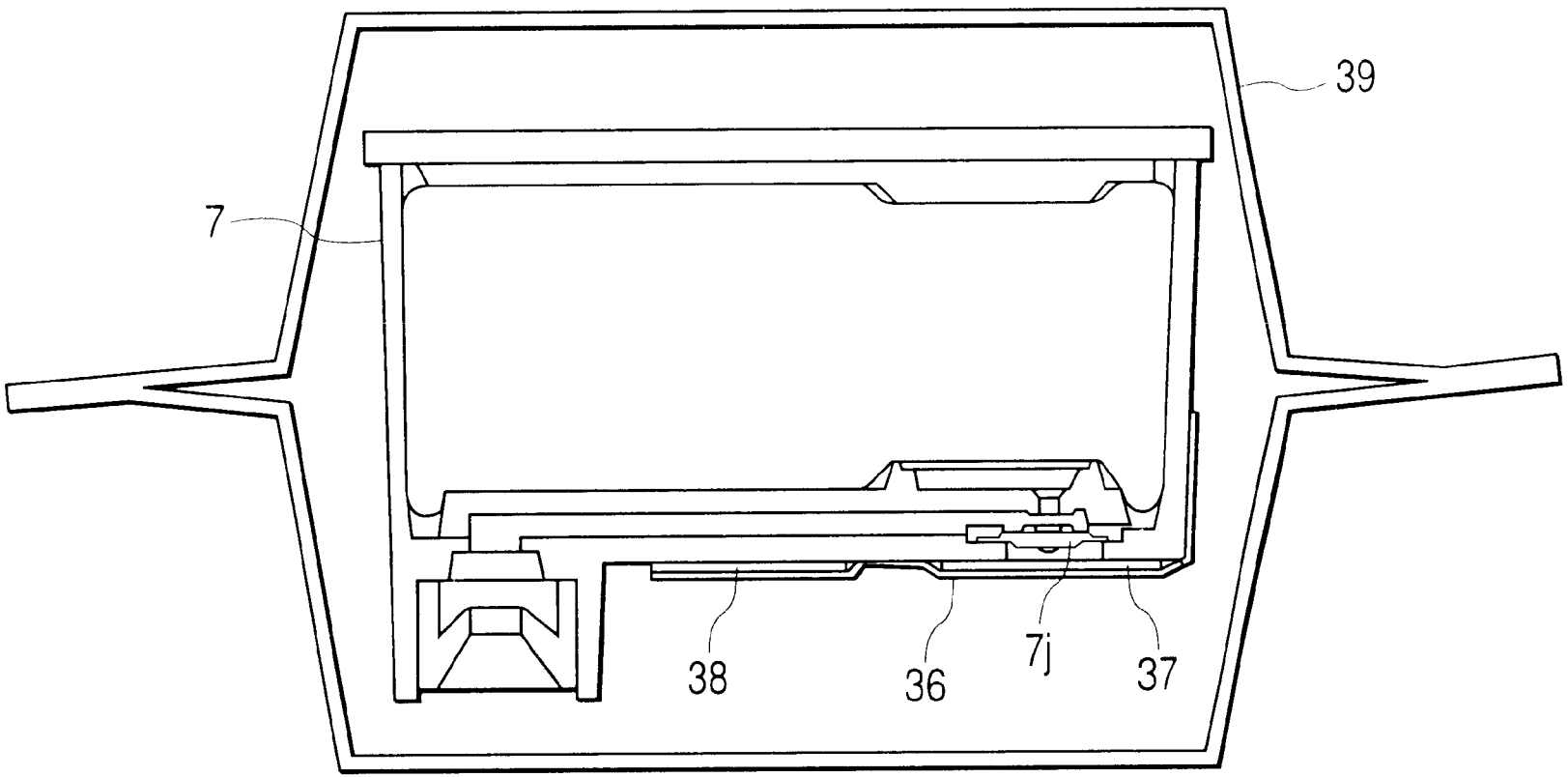
FIG. 12 is a cross sectional view showing the ink FIG. 11 cartridge being packed.

FIG. 12 is a diagram schematically showing a reduced pressure packed state using a packing member 39 having a gas barrier property. In FIG. 12, the packing member 39 is illustrated as the original condition. Accordingly, in the illustration, a sufficient gap is present between the ink cartridge 7 and the packing member 39. However, in the reduced pressure packed state, the packing member 39 is pressed under the atmospheric pressure to be compressed, and brought into close contact with the surface of the ink cartridge 7.

In the structure in which the sealing member 7*j* forming the passage control system is driven by the actuator provided on the recording device, as in the ink cartridge shown in FIG. 8, when the ink cartridge is packed in a reduced pressure state by the packing member 39, the fragile sealing member 7*j* is put in a close contact state by the packing member 39. Therefore, in handling the ink cartridge, an external force may apply to the sealing member 7*j* to damage the sealing member 7*j*.

Figure 11:
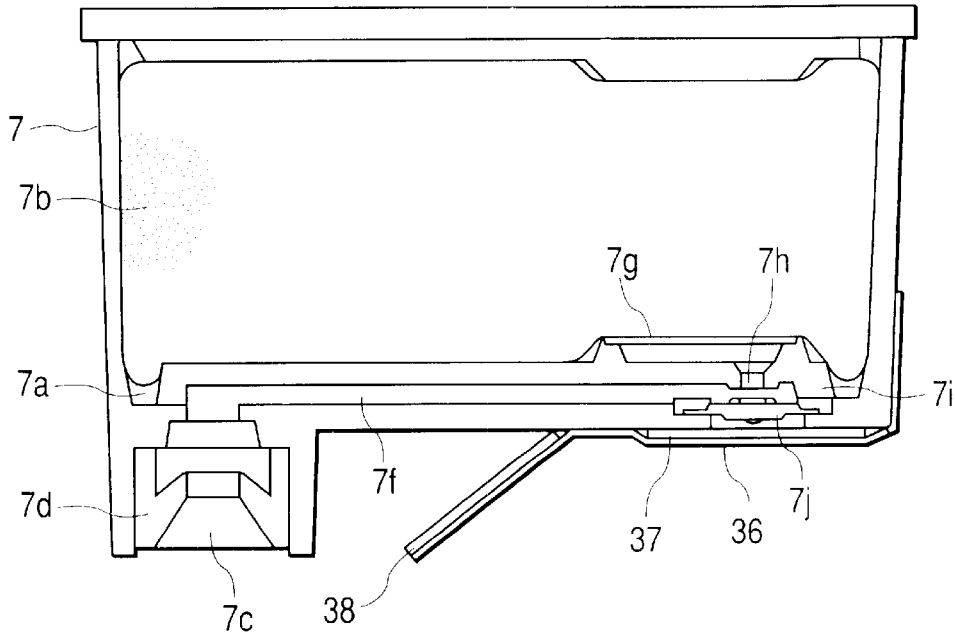
FIG. 11 is a cross sectional view showing a state that the passage control system of the FIG. 8 ink cartridge is covered with a cover member.

To avoid this, it is preferable that the sealing member 7*j* forming the passage control system is covered with a cover member as shown in FIG. 11 and in this state the ink cartridge is packed in a reduced pressure state as shown in FIG. 12. Specifically, a cover member 37 with a rigidity is bonded over the surface of an adhesive tape 36, as shown in FIG. 11. The adhesive tape 36 is stuck to an outer surface of the ink cartridge in a state that the cover member 37 covers the exposed part of the sealing member 7*j*.

A thick sheet 38 is stuck onto an end of the adhesive tape 36, thereby preventing the end of the adhesive tape 36 from being stuck to the outer surface of the ink cartridge.

With this structure, when the user uses the ink cartridge, the user can grip the thick sheet 38 to easily peel off the cover member 37 and the adhesive tape 36 from the outer surface of the ink cartridge. Accordingly, the cartridge exchanging work is easy.

Figure 13:
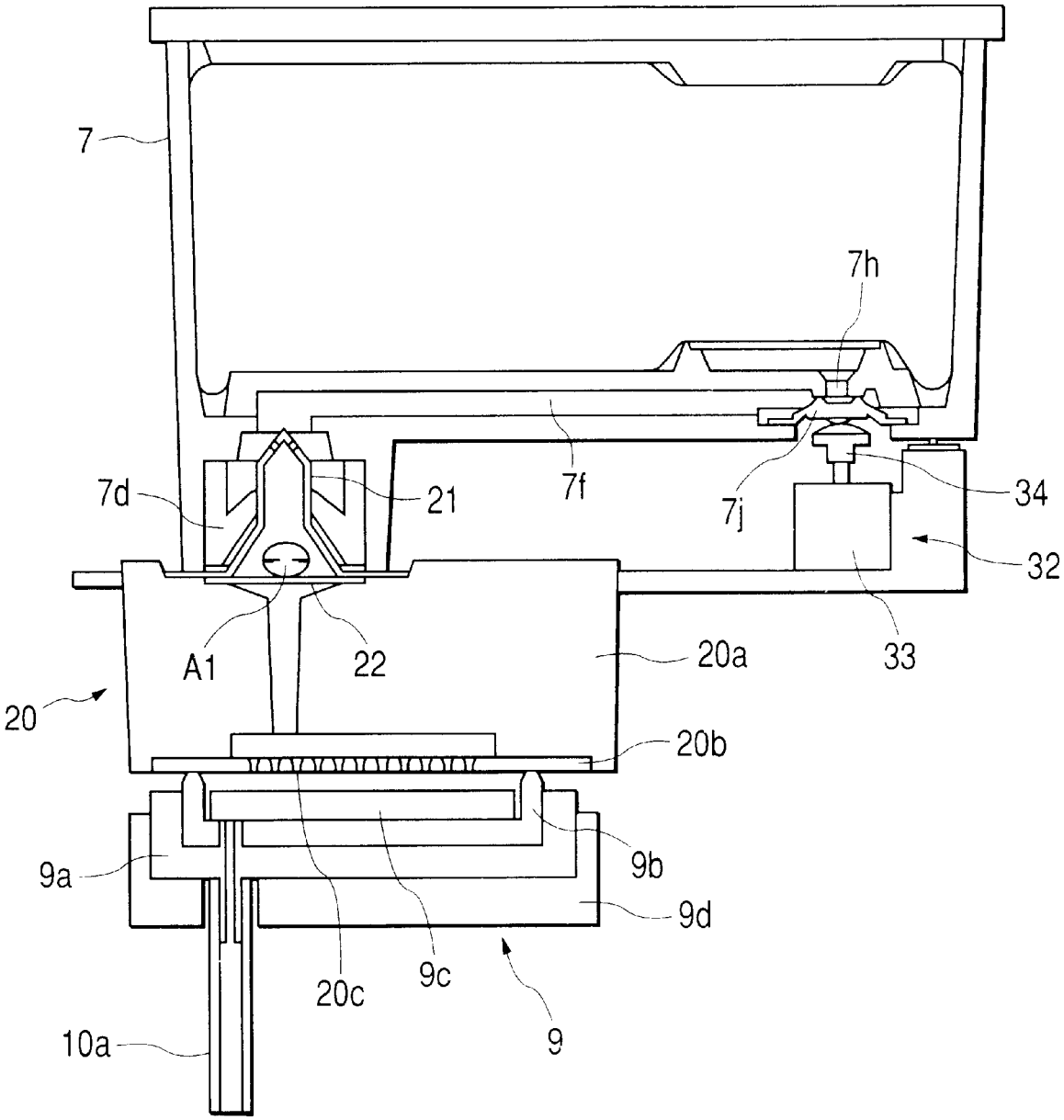
FIG. 13 is a cross sectional view showing the FIG. 8 ink cartridge inclusive of a part of the recording device, the view showing a state that a negative pressure is accumulated by operating the passage control system for valve closing.

FIG. 13 shows a construction of the recording device combined with the ink cartridge of the first embodiment shown in FIG. 8 when the ink cartridge is utilized, and also shows a state that the cleaning operation is performed in the recording device. To utilize the FIG. 8 ink cartridge, the actuator 32 for driving the sealing member 7*j* of the ink cartridge is provided on the carriage of the recording device.

The actuator 32 shown in FIG. 13 forms an electromagnetic valve by the utilization of an electromagnetic drive mechanism 33, as in the case of FIG. 9. If necessary, the cam mechanism 35 provided with the eccentric cam as shown in FIG. 10 may be used for the actuator 32 mounted on the carriage.

When the ink cartridge is mounted on the carriage of the recording device, an ink flow direction in the ink flow passage 7*f* of the ink cartridge is substantially orthogonal to a moving direction of the carriage.

When those directions are related so, the ink existing in the ink flow passage 7*f* of the ink cartridge receives a less inertia caused by the reciprocal motion of the carriage.

If the ink flow direction in the ink flow passage 7*f* of the ink cartridge is coincident with the carriage moving direction, a stability of the ink ejection from the recording head will be lowered by an inertia acting on the ink in the ink flow passage 7*f*, caused by the carriage movement.

Reference numeral 9 in FIG. 13 designates the capping system already stated. The capping system 9 includes a cap case 9*a* whose upper surface is opened and substantially rectangular in shape, and a cap member 9*b* which is made of an elastic material, e.g., rubber, and contained in the cap case 9*a*. The upper edge of the cap member 9*b* is protruded slightly above the cap case 9*a* to form a sealing surface for the nozzle plate 20*b*.

An ink absorbing member 9*c* made of a porous material is place in the inner bottom of the cap member 9*b*.

Figure 14:
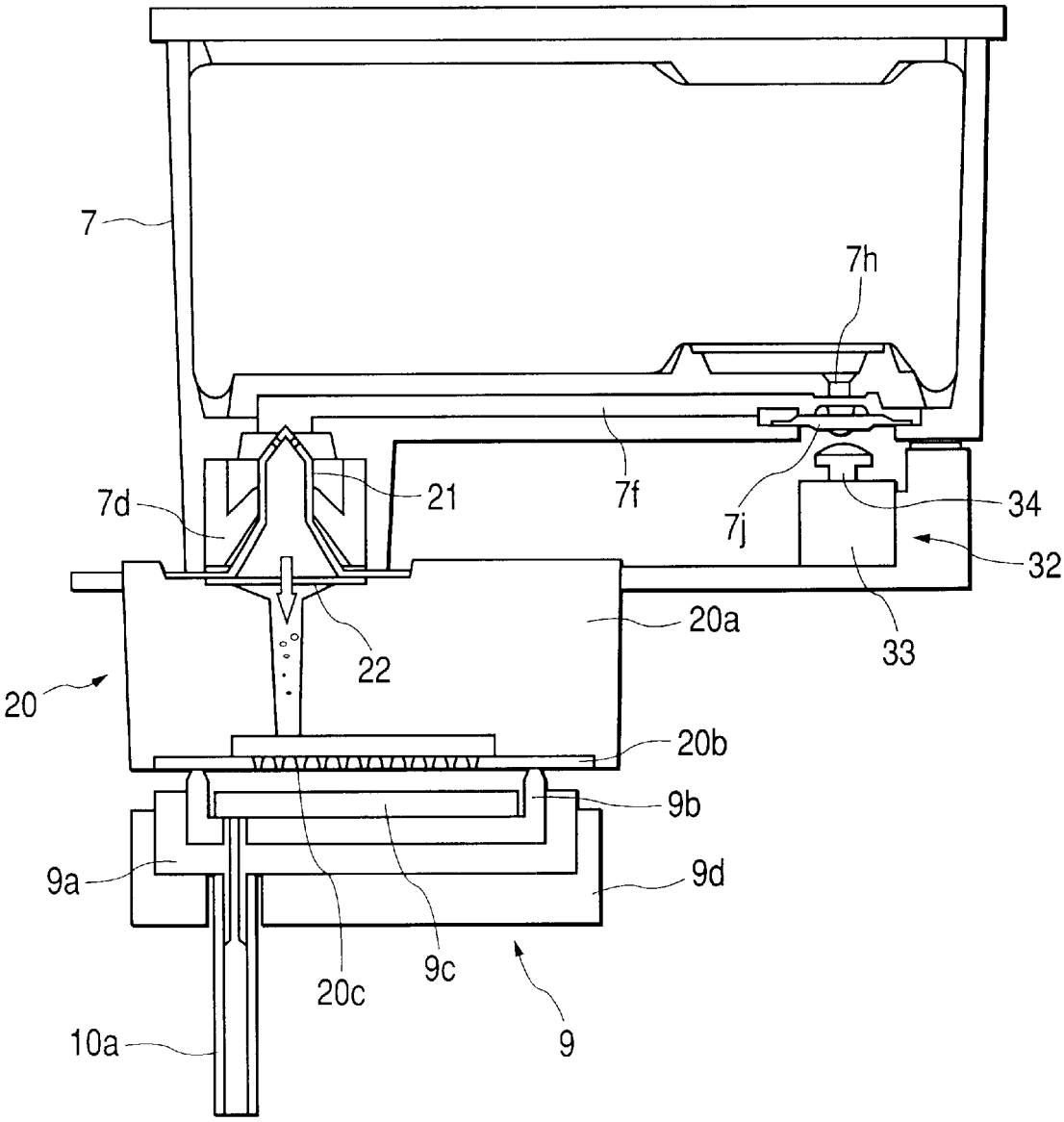
FIG. 14 is a cross sectional view showing a state that the passage control system being in a state shown in FIG. 13 is operated for valve opening, and the ink is discharged.

The cap case 9*a* is held on a slider 9*d*. The slider 9*d* is lifted in conjunction with the movement of the carriage 1 to the home position. With this, as shown in FIGS. 13 and 14, the nozzle plate 20*b* forming the nozzle forming surface of the recording head is sealed with the cap member 9*b*.

When the carriage moves from the home position to the print region, the capping system 9 removes the sealing of the recording head and descends, contrary to the above case, by the action of an unillustrated spring.

A suction port is formed in the inner bottom of the capping system to pass through the cap case 9*a*. One end of a tube 10*a* forming the suction pump 10 serving as a negative pressure generating system is connected to the suction port.

When current is fed to the electromagnetic drive mechanism 33 forming the actuator 32, the operation piece 34 is pushed up, and the sealing member 7*j* of the ink cartridge closes the opening 7*h* formed in the valve seat.

When the suction pump 10 is driven in this state, a negative pressure is accumulated in the inner space of the capping system 9. The negative pressure reaches the sealing member 7*j* of the ink cartridge, and this passage is put in a negative pressure state. When the negative pressure is satisfactorily accumulated, an air bubble A1 staying in the ink supplying needle 21 is expanded by the negative pressure as shown in FIG. 13.

In this state, the current feeding to the electromagnetic drive mechanism 33 forming the actuator 32 is interrupted, and then, as shown in FIG. 14, the sealing member 7*j* of the ink cartridge opens the opening 7*h* of the valve seat. consequently, a fast ink flow occurs instantaneously. Accordingly, the air bubble A1 in the ink supplying needle 21, as shown in FIG. 14, passes through the filter member 22, and is discharged to the capping system 9 in the form of fine bubbles.

Figure 15:
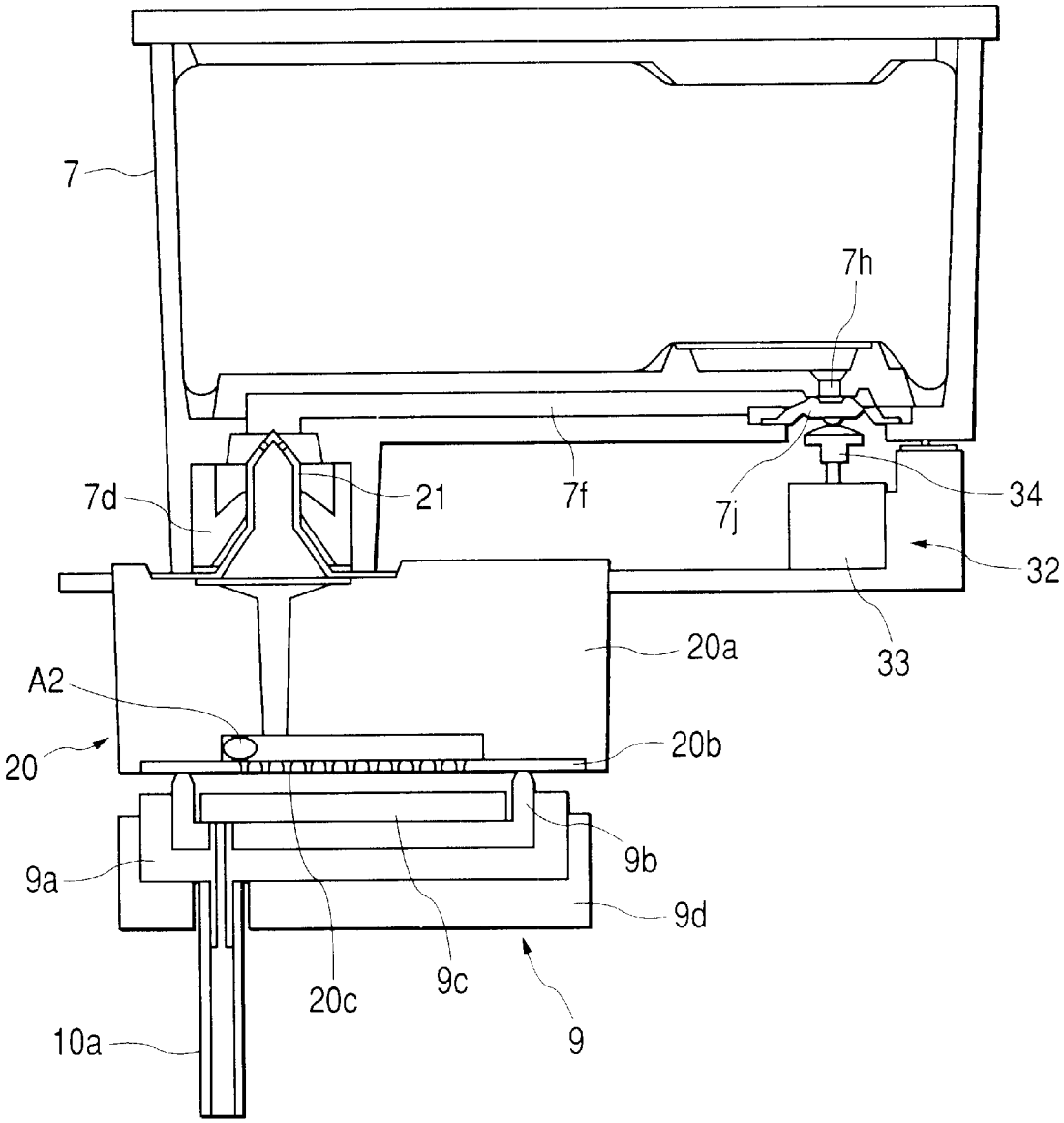
FIG. 15 is a cross sectional view showing another state that the passage control system is operated for valve closing and a negative pressure is accumulated.
Figure 16:
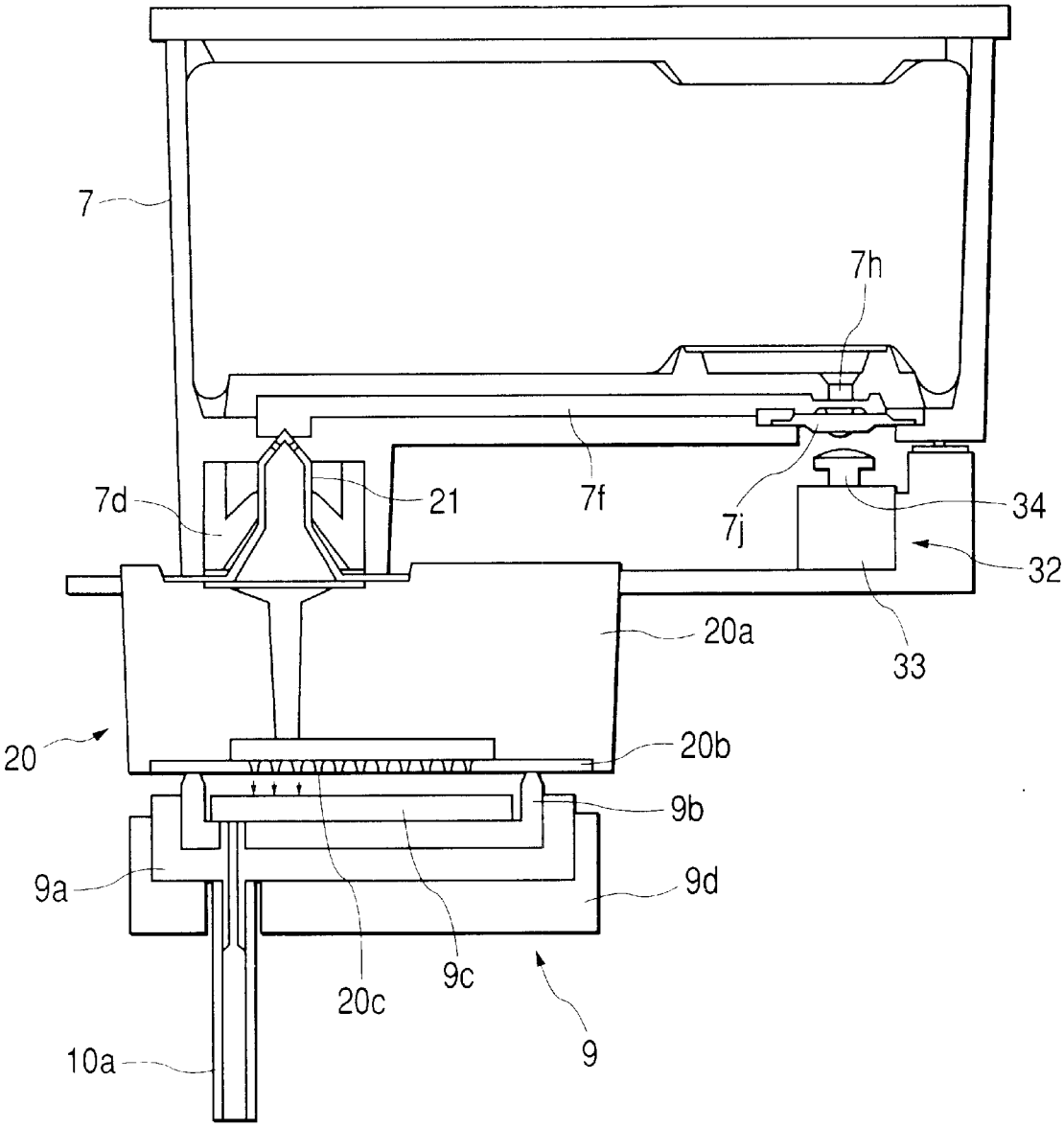
FIG. 16 is a cross sectional view showing a state that the passage control system being in a state shown in FIG. 15 is operated for valve opening, and the ink is discharged.

FIGS. 15 and 16 show a state that air bubbles, which stay at a stagnant part in the ink flow passage formed in the recording head 20 are also discharged by the cleaning operation. In those figures, like or equivalent portions are designated by like reference numerals in FIGS. 13 and 14.

In the head case of the recording head 20, as stated with reference to FIG. 7, ink of respective colors is led to the pressure chambers associated with the actuators 20*d* constructed by piezoelectric vibrators, via ink flow passages 20*e*. With those component parts arranged, the ink flow is considerably complicated, inevitably causing stagnant parts at various locations. FIG. 15 schematically show an air bubble A2 staying at a stagnant part.

When a negative pressure, as shown in FIG. 15, is applied to the air bubble A2 staying at the stagnant part, the air bubbles A2 is expanded, so that the bubble easily moves from the stagnant part. As shown in FIG. 16, when the valve closing state by the sealing member 7*j* of the ink cartridge is released, the air bubble A2 can be discharged to the capping system 9 by an instantaneous fast ink flow.

Figure 17:
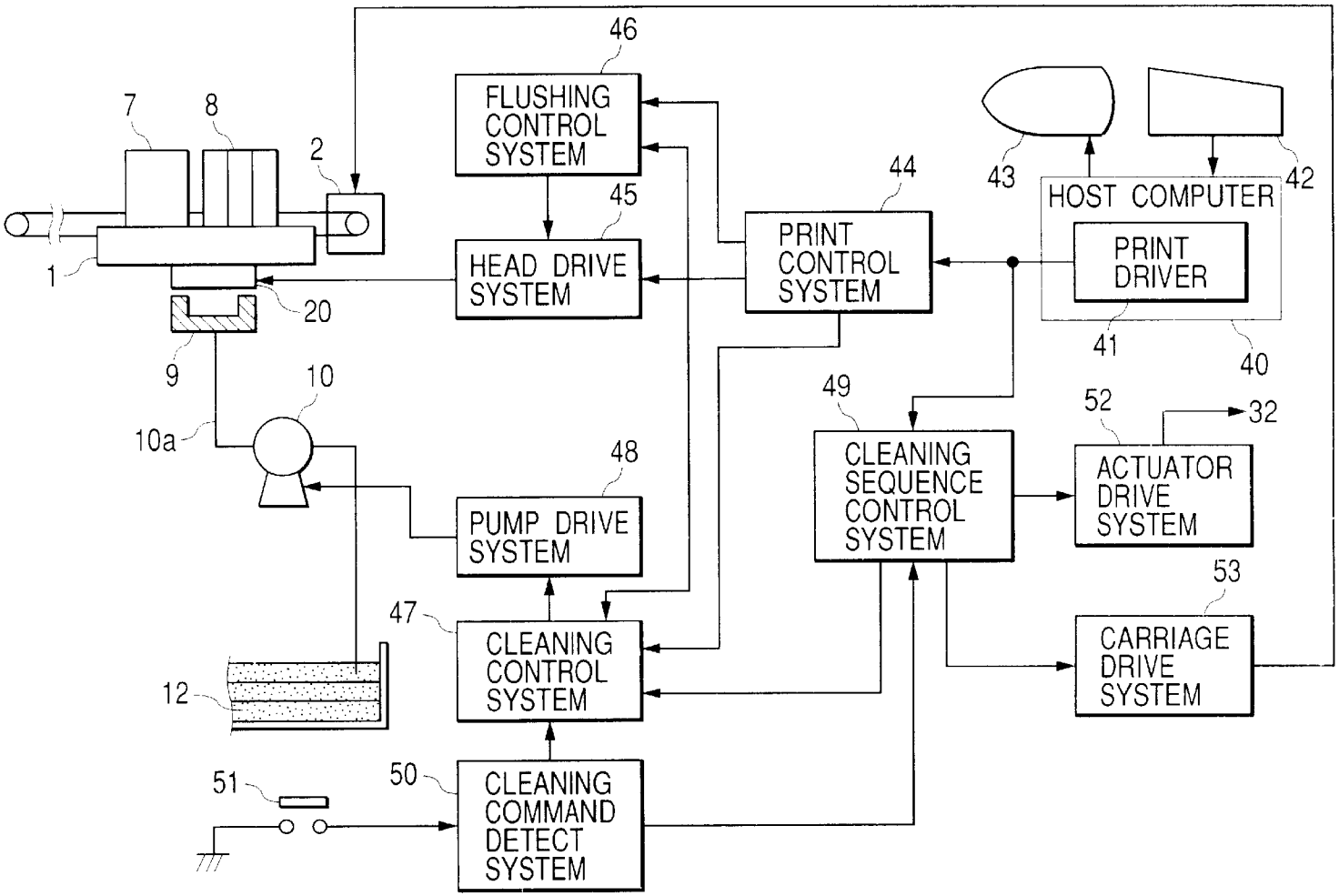
FIG. 17 is a block diagram showing a control circuit for executing the cleaning control mentioned above.

FIG. 17 is a block diagram showing an example of a control circuit for executing the cleaning control mentioned above. In FIG. 17, like or equivalent portions are designated by like reference numerals. One end of the tube 10*a* forming the tube pump 10 as a negative pressure generating system, as shown in FIG. 17, is connected to the capping system 9. The other end of the tube is connected to a waste liquid tank 12. The waste ink that is discharged into the inner space of the capping system 9 through the cleaning operation is discharged into the waste liquid tank 12 through the tube pump 10.

In FIG. 17, reference numeral 40 designates a host computer. A print driver 41 is installed in the host computer 40. Through a utility of the print driver 41, known selection and entering operations, such as selection of paper size, monochromatic or color print, and recording mode, and entering of data, e.g., font, and print command are performed by the utilization of an input unit 42 and a display unit 43.

Also in the embodiment, the input unit 42 and the display unit 43, as will be described later, are utilized to designate operation timing at which actuators 32 each for driving the sealing member 7*j* contained in the ink cartridge are activated.

In response to a print command entered on the input unit 42, the print driver 41 sends print data to a print control system 44 contained in the recording device. The print control system 44 generates bit map data based on the print data transferred from the host computer 40, and causes a head drive system 45 to generate drive signals in accordance with the bit map data, thereby ejecting ink from the recording head 20.

The head drive system 45 receives a flushing command signal from a flushing control system 46, other hand the drive signal based on the print data, and outputs a drive signal for the flushing operation to the recording head 20.

Reference numeral 47 designates a cleaning control system. In response to a command from the cleaning control system 47, a pump drive system 48 operates to drive and control the suction pump 10. The cleaning control system 47 receives a cleaning command signal from the print control system 44, a cleaning sequence control system 49 and a cleaning command detect system 50.

An operation switch 51 is connected to the cleaning command detect system 50. When the user operates or pushes the operation switch 51, the cleaning control system 47 operates through the cleaning command detect system 50. In this way, the cleaning operation is manually executed.

The cleaning control system 47 is also operated through the print control system 44 by operating the input unit 42 of the host computer 40, and the cleaning operation is executed.

The cleaning sequence control system 49 receives commands from the host computer 40 and the cleaning command detect system 50, and sends control signals to an actuator drive system a52 and a carriage drive system 53.

The actuator drive system 52 sends a control signal to the actuator 32 for driving the sealing member 7*j* in the ink cartridge 7, whereby the ink flow passage 7*f* of the ink cartridge 7 is closed or its flow resistance is increased, or the reverse operation is performed.

The carriage drive system 53 receives a command from the cleaning sequence control system 49, and drives the carriage motor 2 to move the recording head 20 to a position just above the capping system 9 where the nozzle forming surface of the recording head is sealingly covered with the capping system 9.

Figure 18:
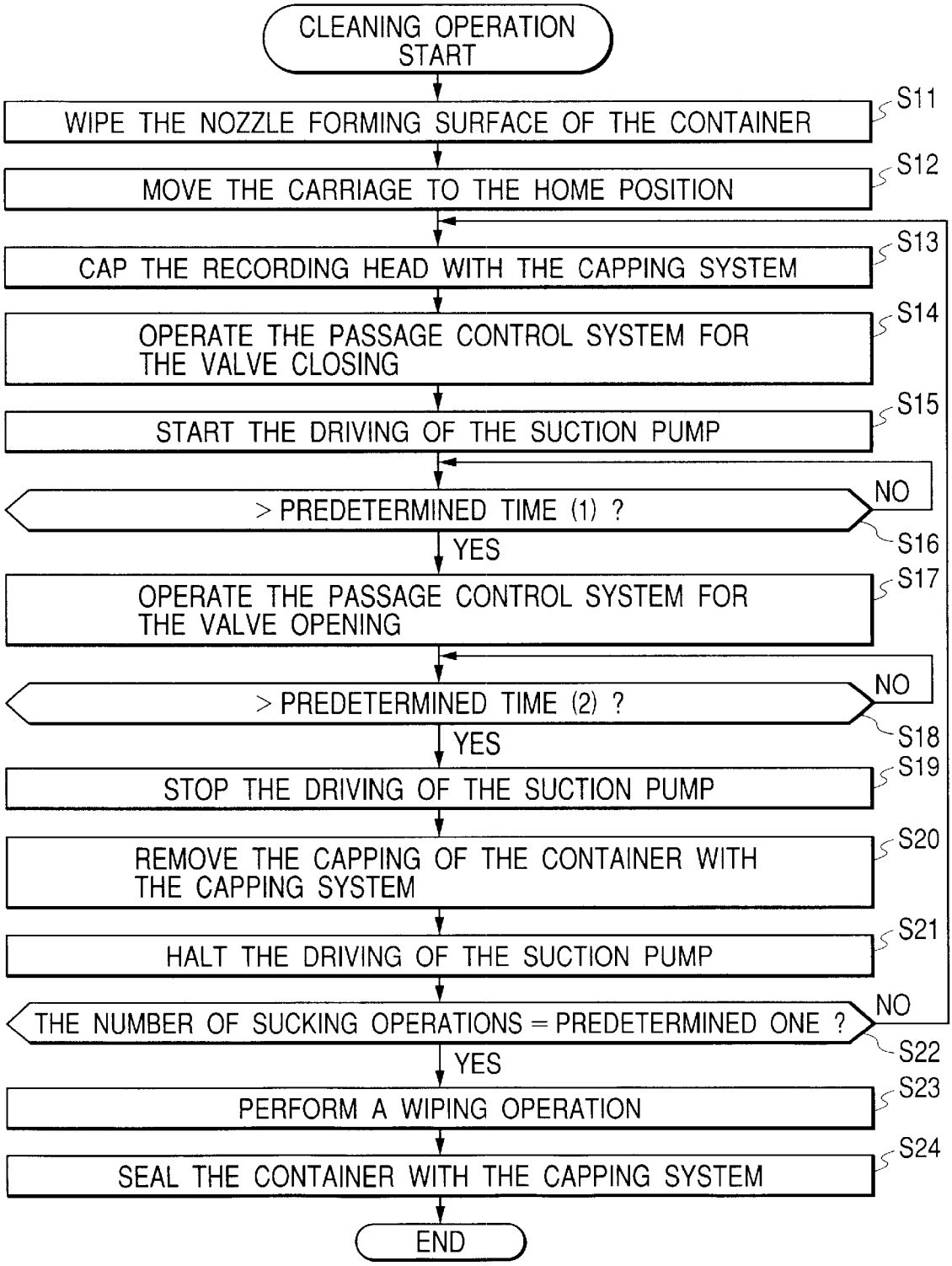
FIG. 18 is a flow chart showing a cleaning sequence executed by the FIG. 17 control circuit.

FIG. 18 is a flow chart showing a cleaning operation of the recording head, which is performed in the recording device constructed as described above. A sequence of the cleaning operation steps will be described with reference to FIG. 18 and also the block diagram shown in FIG. 17. When a cleaning command is issued by operating the operation switch 51 arranged on the recording device or by the operation of the input unit 42 of the host computer 40, the cleaning sequence control system 49 receives the command and produces control signals. In this way, the cleaning operation starts.

And, the cleaning sequence control system 49 sends a command signal to the carriage drive system 53. In response to the command signal, the carriage motor 2 is driven to move the carriage 1 above the wiping member which has advanced to the moving path of the carriage. Consequently, the nozzle forming surface of the recording head 20 is wiped out with the wiping member 11 (step S11).

Subsequently, the carriage 1 is moved to the home position (step S12), and the nozzle forming surface of the recording head 20 is capped with the capping system 9 (step S13).

At the same time, the passage control system operates for the valve closing (step S14). Specifically, the cleaning sequence control system 49 sends a command signal to the actuator drive system 52, so that the actuator 32 is driven to cause the sealing member 7*j* forming the passage control system in the ink cartridge 7 to close the ink flow passage 7*f*.

Subsequently, the driving of the suction pump 10 starts (step S15). In this case, the cleaning sequence control system 49 shown in FIG. 17 sends a control signal to the cleaning control system 47, and in turn the cleaning control system 47 sends a command signal to the pump drive system 48. As a result, the suction pump 10 is driven, and a negative pressure is applied to the inner space of the capping system 10, and the negative pressure gradually increases.

In this state, it waits till a predetermined time (1) elapses from the start of the suction pump 10 driving (step S16). When the negative pressure applied to the capping system 9 reaches to a peak level or its near value, the passage control system operates for the valve opening, viz., the sealing member 7*j* of the black ink cartridge 7 operates for the valve opening (step S17). In this case, the sequence control system 49 manages the predetermined time (1), while at the same time, it sends a control signal to the actuator 32, to execute the valve-opening operation of the sealing member 7*i* in the black ink cartridge 7.

Following the valve opening operation of the sealing member 7*j*, it waits till a predetermined time (2) elapses after the sealing member 7*j* operated for valve opening (step S18). When it judges that the predetermined time (2) has elapsed in the step s18, the driving of the suction pump 10 is halted (step S19).

In this case, the cleaning sequence control system 49 manages the predetermined time (2), while at the same time halts the driving operation of the suction pump 10 by sending a control signal to the cleaning control system 47.

Figure 19:
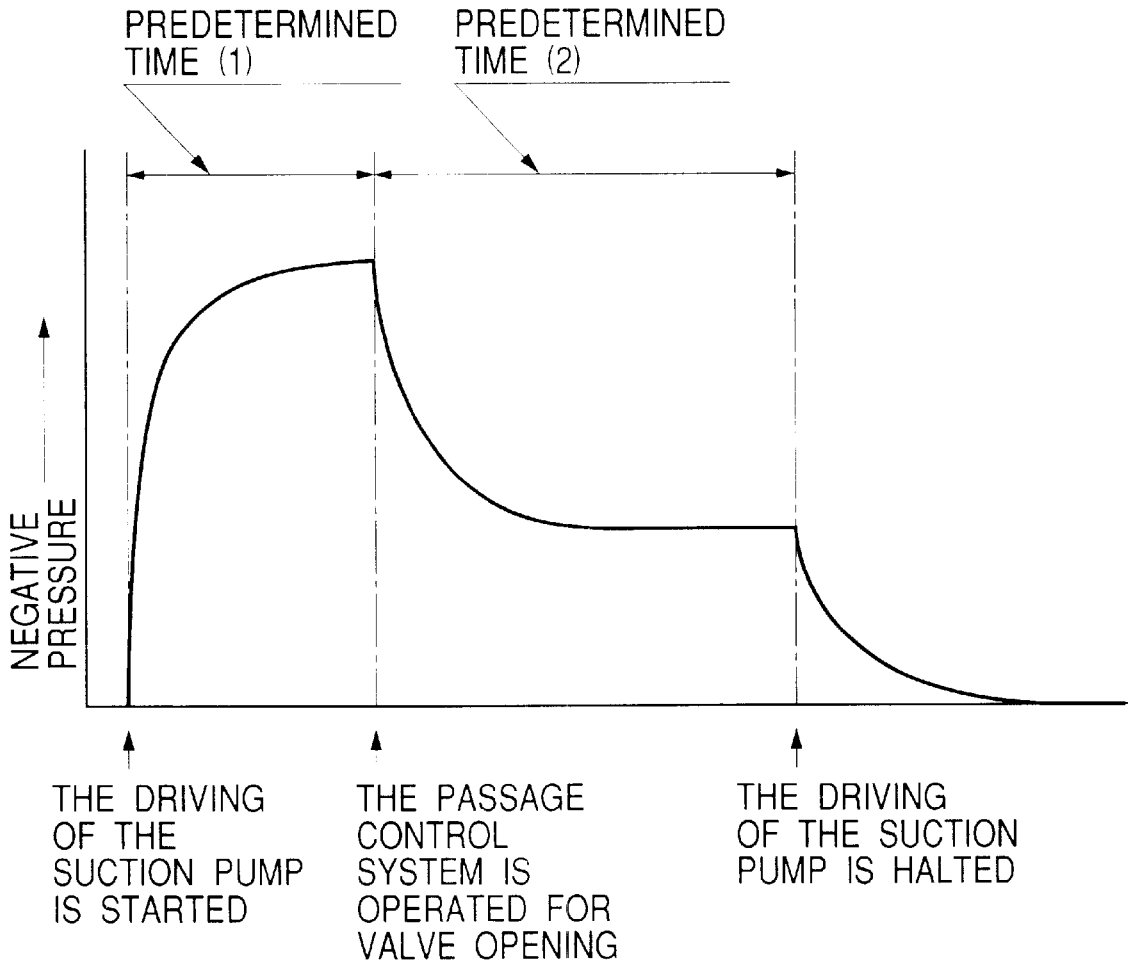
FIG. 19 is a graph showing how a negative pressure is applied in the cleaning sequence of FIG. 18.

A variation of a negative pressure, which is applied to the capping system 9 through the control sequence from the steps S15 to S19, is plotted in FIG. 19. As seen from FIG. 19, when the driving of the suction pump 10 starts, a negative pressure in the inner space of the capping system 9 sharply rises.

When the predetermined time (1) elapses and the negative pressure reaches a peak level or its near position, the sealing member 7*j* in the cartridge 7 is operated for valve opening. As a result, the negative pressure abruptly drops and approaches to atmospheric pressure. In this state, the driving of the suction pump 10 continues. Accordingly, the negative pressure does not drop to atmospheric pressure and settles down at a predetermined negative pressure level.

When the predetermined time (2) elapses after the sealing member 7*j* of the ink cartridge 7 is put to a valve opening state, the driving of the suction pump is halted, and the negative pressure drops to atmospheric pressure.

As seen from the negative pressure characteristic shown in FIG. 19, at a time point where the predetermined time (1) terminates, the sealing member 7*j* is put to the valve opening mode. As a result, a fast ink flow occurs in the ink flow passage ranging from the ink cartridge to the nozzle apertures of the recording head 7. The fast ink flow expands air bubbles staying within or adhering to the ink flow passage, or separates them from the ink flow passage.

Also during the predetermined time (2), the driving of the suction pump 10 continues and the ink suction continues. Accordingly, the separated air bubbles are discharged along with the ink flow.

Returning to FIG. 18, a step S20 is executed to release the capping of the recording head 20 with the capping system 9. In a step S21, the suction pump 10 is temporarily driven and then halted. As a result, the waste ink having been discharged into the capping system 9 is wasted into the waste liquid tank 12 by the suction pump 10.

In the next step S22, it judges whether or not the number of ink sucking operations reaches a predetermined number. If it does not reach the predetermined member, the control sequence from the steps S13 to S21 is repeatedly executed. If it is judged in step S22 that the number of ink sacking operations reaches the predetermined number, a step S23 is executed, viz., the wiping operation is performed, so that ink left on the nozzle forming surface of the recording head is wiped out by the wiping member 11.

In a step S24, the recording head 20 is sealingly capped with the capping system 9, and waits for the arrival of incoming print data. The step S22 checks if the number of ink sucking operations reaches the predetermined number. However, where one sucking operation provides a satisfactory restoring effect, the judging step S22 is not required.

The cleaning operation thus far described is a manual cleaning operation which is performed by operating the operation switch 51 on the recording device or the input unit 42 of the host computer 40. It is preferable to program such that the cleaning operation mentioned above is automatically executed during an initial ink filling operation in which ink is initially filled into the recording device.

In the initial ink filling operation in which ink is initially filled into the recording device, much air bubbles are like to stay within the ink supplying needles and the ink flow passages of the recording head, as described above.

Accordingly, in a case where the ink flow passages of the recording head are first filled with ink, it is preferable to use ink high in degassed rate. There is a limit in increasing the degassed rate. Further, during the initial filling operation, the ink is fed to the ink flow passages while being replaced with an air layer. Accordingly, the degassed rate rapidly decreases.

For this reason, it is very important to reliably remove air bubbles at the time of the initial ink filling. The removal of air bubbles will ensure a stable printing operation.

It is preferable to program so that when the user enters a manual cleaning command again within a range of a predetermined printing quantity, the cleaning operation mentioned above is executed.

The case where the manual cleaning operation is performed again within the predetermined printing quantity frequently occurs when the user recognizes a print failure and the cleaning operation is executed again. In such a case, there is a possibility that relatively large air bubbles flow into the ink flow passage of the recording head to hinder the filling of ink.

Figure 20:
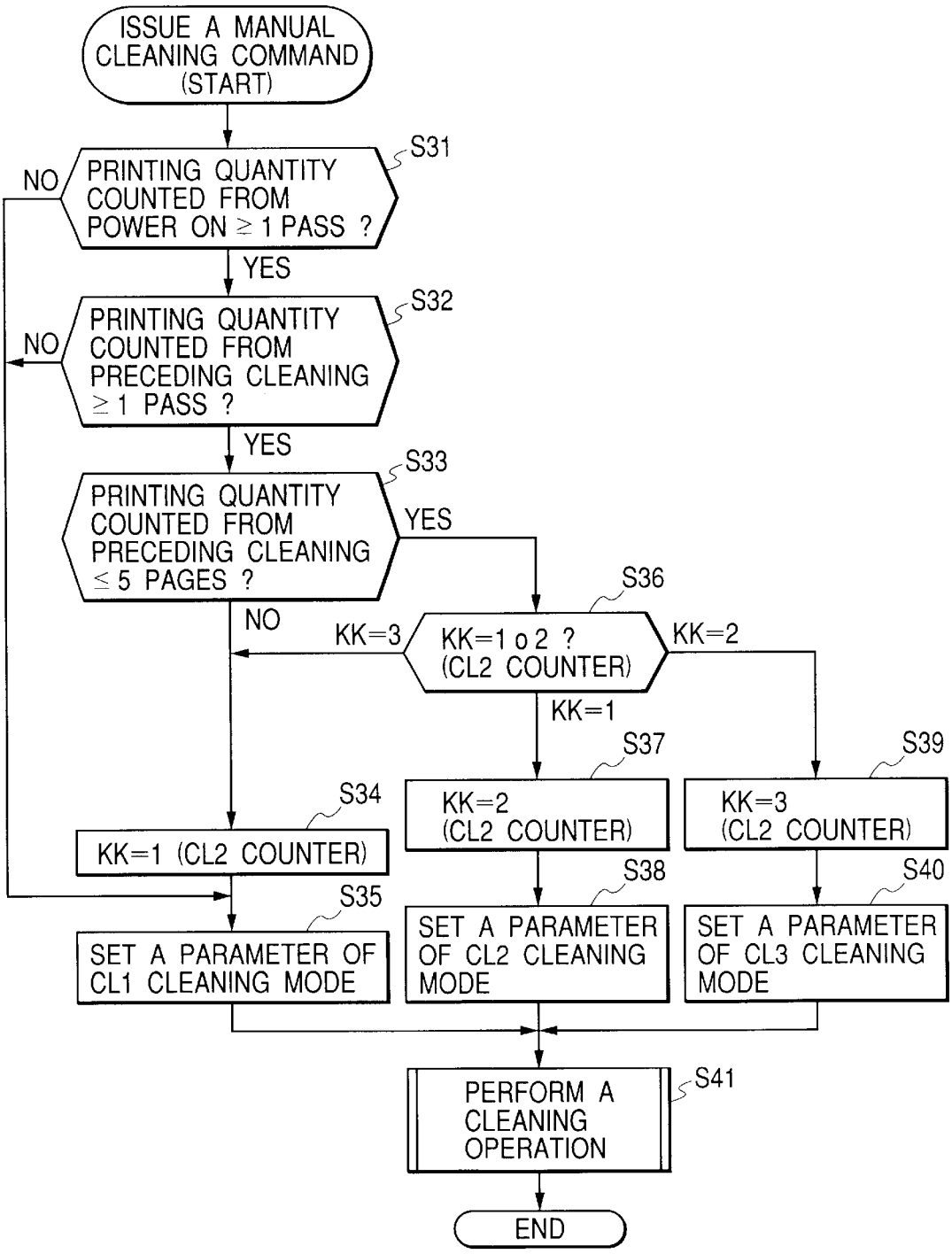
FIG. 20 is a flow chart showing a control sequence for a cleaning operation, which is executed when a manual cleaning command is issued again within a predetermined printing quantity.

FIG. 20 shows an example of a control sequence of a cleaning operation performed when a manual cleaning operation command is issued within a predetermined printing quantity as mentioned above.

The control sequence of FIG. 20 is featured by a CL2 counter (KK), which judges which of the cleaning modes is to be selected, in a step S36, in accordance with a printing quantity after the previous cleaning operation is executed, and manages it. In the embodiment, any of three cleaning modes is selected in the control.

In the control, a value of the CL2 counter (KK) is replaced, and a parameter for a respective cleaning mode is set, whereby the cleaning mode specified is performed in a step S41.

The operation sequence of FIG. 20 starts in response to a manual cleaning operation command issued when the operation switch 51 of the recording device or the input unit 42 of the host computer 40 is operated.

In a step S31, a print history stored in the print control system 44 is referred to, and the control judges whether or not the printing of one pass or larger has been performed since the power source for the recording device is turned on. If the printing of one pass or larger is not yet performed (the answer is NO), a step S35 is executed and a parameter for a CL1 cleaning mode is set.

This CL1 mode indicates a type of cleaning operation mode. The CL1 cleaning mode is a cleaning mode in which the least amount of the ink is sucked. CL2 and CL3 cleaning modes to be described later are cleaning modes in which the amounts of ink sucked are increased in this order. In this case, in place of varying the amount of the ink sucked, an ink suction velocity may be varied.

The ink suction amount is varied to avoid such a situation that even in a slight printing failure, a large amount of ink is consumed. By so doing, undue waste of ink is avoided.

Then, a step S41 is executed to perform a cleaning operation. Specifically, when the recording device receives a cleaning operation command immediately after the power source of the recording device is turned on, the CL1 cleaning mode sucking the least amount of ink is executed.

When the control judges that the printing of at least one pass has been performed (the answer is YES), the control advances to a step S32. In this step, the control judges if the printing of one pass or more has been performed since the previous cleaning operation was performed. If the printing of one pass or more is not carried out (the answer is NO), the control advances to the step S35 as in the previous case. And, the cleaning operation of the CL1 cleaning mode is performed.

When the printing of one pass or more has been performed after the previous cleaning operation (the answer is YES), a step S33 is executed to check if the printing quantity counted from the previous cleaning operation is 5 pages or smaller.

When the printing of 5 pages or more has not been performed after the previous cleaning operation (the answer is NO), the control advances to a step S34 and sets "1" for a count value KK of a CL2 counter, and goes to the step S35. Here, "KK" of the CL2 counter is a counter value used for specifying selection order of the cleaning modes in the following way in the cleaning selection operation.

That is, KK=1 is re-defined, and then, a CL1 mode is set up to execute a first cleaning mode (CL1). For the subsequent cleaning operation, since KK=1 has been defined, KK=2 is re-defined, and then a CL2 mode is set up to execute a second cleaning mode (CL2).

For the next cleaning operation, since KK=2 has been defined, KK=0 is re-defined and then a CL3 mode is set up to execute a third cleaning operation (CL3). In this way, a sequence of cleaning modes CL1→CL2→CL3 is repeated. As the cleaning mode progresses from CL1 to CL3, the amount of ink sucked increases. In the CL3 cleaning mode, the strongest cleaning is carried out.

The fact that the cleaning operation is successively performed implies that the recording device is hard to resume its normal printing state. In this case, it is necessary to shift the cleaning operation to a stronger cleaning operation. It is for this reason that the above-mentioned control is used.

When in the step S33, the control judges that the printing quantity is not 5 pages or smaller after the previous cleaning operation is performed (the answer is NO), and when the user enters a cleaning command again, the control judges that the printing state of the recording device was successfully restored, but another trouble occurs to require another cleaning operation, and the KK of the CL2 counter is set to "1"; KK=1. As a result, the CL1 cleaning mode is set up.

When in the step S33, the control judges that the printing quantity is 5 pages or smaller after the previous cleaning operation is performed (the answer is YES), the step S36 is executed to verify a count value of the CL2 counter.

When KK=3, the control goes to the step S34. When KK=1, the control goes to a step S37. In this step, the CL2 counter is set to "2" (KK=2), and in the next step S38, a parameter of the CL2 cleaning mode is set.

Accordingly, the cleaning operation by a step S41 following the step S38 is the second cleaning mode (CL2) that was set up in the previous step S38. When KK=2 in the step s36, the control proceeds to a step S39. In this step, the CL2 counter is set to "3" (KK=3). In the subsequent step S40, a parameter of the CL3 cleaning mode is set.

Accordingly, the cleaning operation performed in a step S41 following the step S40 is a third cleaning mode (CL3) that was set up in the step S40.

As described above, in the operation sequence shown in FIG. 20, when a manual cleaning command is issued, the cleaning operation is selected in accordance with the printing quantity produced after the previous cleaning operation. Accordingly, the cleaning operation is optimumly selected in accordance with the current printing condition. This accrues to reduction of a waste of ink.

The cleaning operations mentioned above have been discussed on condition that the sealing member as the passage control system in the black ink cartridge, and the three sealing members also as the passage control system in the color ink cartridge are concurrently opened and closed.

In other words, the cleaning operations have been discussed on condition that a negative pressure accumulating step in which the nozzle forming surface of the recording head is sealed with the capping system, the sealing members of the ink cartridges are each put to a valve closing state and in this state, a negative pressure is applied from the suction pump to be accumulated in the capping system, and a negative pressure releasing step in which the sealing members of the ink cartridges are each placed to a valve opening state in a state that the negative pressure is accumulated in the capping system, are each executed concurrently.

Ink high in coloring density, e.g., black ink, has a problem in which restoring ability by the cleaning operation is low in comparison to ink of other colors. Accordingly, where the operation sequence mentioned above is used, the nozzles ejecting color ink first resume their normal ejecting function, and thus the color ink is further discharged into the capping system, whereas a negative pressure is hard to act on the nozzles ejecting black ink.

To cope with the problem, it is desirable to independently control the sealing members as the passage control system by the actuators 32.

In this case, the negative pressure accumulating step and the negative pressure releasing step are capable of driving only the sealing member of a specific ink passage. Such a control is also possible that the negative pressure accumulating step is executed concurrently, and only the negative pressure releasing step is executed for specific ink passage. With the control, the negative pressure is applied to only the ink cartridge storing a specific ink, whereby the cleaning operation is performed.

For example, the sealing members respectively provided to the ink flow passages of the black ink cartridge and color ink cartridge are controlled to be closed concurrently, and the negative pressure is applied thereto, and then the sealing member in the black ink cartridge is controlled to be open, whereby ink can be discharged only from nozzles for the black ink high in coloring density by the negative pressure. This makes it possible to concentrically execute the cleaning operation on the nozzles ejecting the black ink.

The cleaning process for the nozzles apertures ejecting specific ink is preferably executed by using a control program installed in the recording device. In this case, the cleaning process for the nozzles ejecting specific ink is preferably performed depending on a left standing time after the printing operation of the recording device ends.

The cleaning operation for the specific ink is preferably performed by using a utility of a print driver installed in a host computer, or it is designated by a button (not shown) or the like provided on the recording device, and the cleaning operation is preferably performed to correspond to the specific ink in accordance with the designation information.

Description has been made placing emphasis on the efficient cleaning operation achieved by controlling the passage control system of the ink flow passages of the ink cartridges for valve opening and closing. If required, the following control may also be realized by the utilization of such a construction that the passage control system are individually controlled for valve opening and closing.

The recording device includes an ink end detecting system for detecting an ink end state in the ink cartridge. If the passage control system, or the sealing member 7*j*, of the ink flow passage 7*f* the ink end of which state is detected, is kept in a valve closing state at least in a state that the negative pressure is applied from the negative pressure generating system to the capping system, it is possible to eliminate a case in which the ink is completely discharged from the ink chamber or the ink chamber is empty, as the result of the ink discharging by the cleaning operation.

As already stated in the embodiment description, the porous material (foam) 7*b* is contained in each ink storage chambers 7*a*. In the ink cartridge in which the ink is stored in a state that the porous material 7*b* is impregnated with the ink, when the ink is completely used up and the ink chamber is empty, air flows into the ink chamber through the air communication hole. Consequently, it is impossible to apply a negative pressure thereto.

When the ink flow passage is empty, the subsequent bubble discharging ability is damaged. Accordingly, when an ink end state is detected, the sealing member 7*j* associated with the empty ink flow passage is individually kept in a valve closing state. By so doing, there is no chance that the problem as stated above occurs.

As to the ink end detecting system, the ink cartridge (foam cartridge) in which the ink is stored in a state that the porous material 7*b* is impregnated with the ink as in the embodiment can employ a software ink end detecting system.

The software ink end detecting system detects an ink end state in a manner that in the printing and flushing operations, an amount of used ink and an amount of ink consumed by the cleaning operation are obtained by counting the number of ink droplets ejected from the recording head, and those count values are summed.

A hardware ink end detecting system may be used for the ink cartridge of the type in which the ink is stored by putting ink in an ink pack made of a flexible material (although it is not presented in the embodiment). The hardware ink end detecting system mechanically detects a physical variation of the ink pack and judges if an ink end state is set up, from the detecting result. The recording device using the ink pack type ink cartridge also produces similar useful effects in a manner that when the hardware ink end detecting system detects an ink end, the above-mentioned control is executed.

In a color ink cartridge containing inlet plural colors, based on the foam ink cartridge, when one color ink storage chamber is put in an ink end state, it is a common practice that the color ink cartridge is exchanged with a new one although ink of other colors are still left therein.

In the case of the ink cartridge which is provided with the passage control system, or the sealing members 7*j*, for the color storage chambers as mentioned above, ink of other color left in the chambers can be fully used.

Specifically, in performing the printing operation, the passage control system associated with the ink passage the ink end of which is detected is kept in a valve closing state, while the ink left there is used for printing.

Only the yellow ink is difficult in its identification. In this case, of other ink than the ink used up and the yellow ink, the ink the amount of which is largest is preferably used for printing.

In the printing using other ink than the ink used up, it is preferable to inform that the printing will be performed using other ink than the used up ink, by using a utility of a print driver installed in a host computer.

In the printing operation using other ink than the used upink, it is preferable to send a request to judge if the printing using other ink than the used up ink is to be performed by using the utility of a print driver installed in a host computer.

In a specific example, when the black ink cartridge is placed to an ink end state, the printing may be performed in a composite black by using the remaining color ink of cyan, magenta and yellow. In this case, the user recognizes the judgement request and instructs the recording device to print in the composite black.

As seen from the foregoing description, the ink cartridge of the second mode includes the passage control system provided in the ink flow passage ranging from the ink storage chamber to the ink supply port. The passage control system is capable of closing the ink flow passage or increasing a flow resistance of the ink flow passage by receiving a driving force of the actuator. Therefore, the passage control system of the ink cartridge is controlled so as to operate for valve opening and closing or to vary the flow resistance by the actuator of the recording device or the ink cartridge.

Accordingly, the air bubbles staying, for example, on the filter member within the supplying needle are effectively discharged by operating the passage control system for valve opening in a state that the negative pressure is accumulated in the inner space of the capping system.

An ink jet recording device employing the cleaning control method according to this invention performs an effective cleaning operation by the utilization of the ink cartridge of the second mode. Further, the passage control system are individually controlled for each color ink. Accordingly, the cleaning operation can efficiently be perform corresponding to specific ink.

That is, in the second mode of the present invention, the passage control system may be independently operated in an ink supply port by ink supply port basis or in an ink cartridge by ink cartridge basis.

Figure 21:
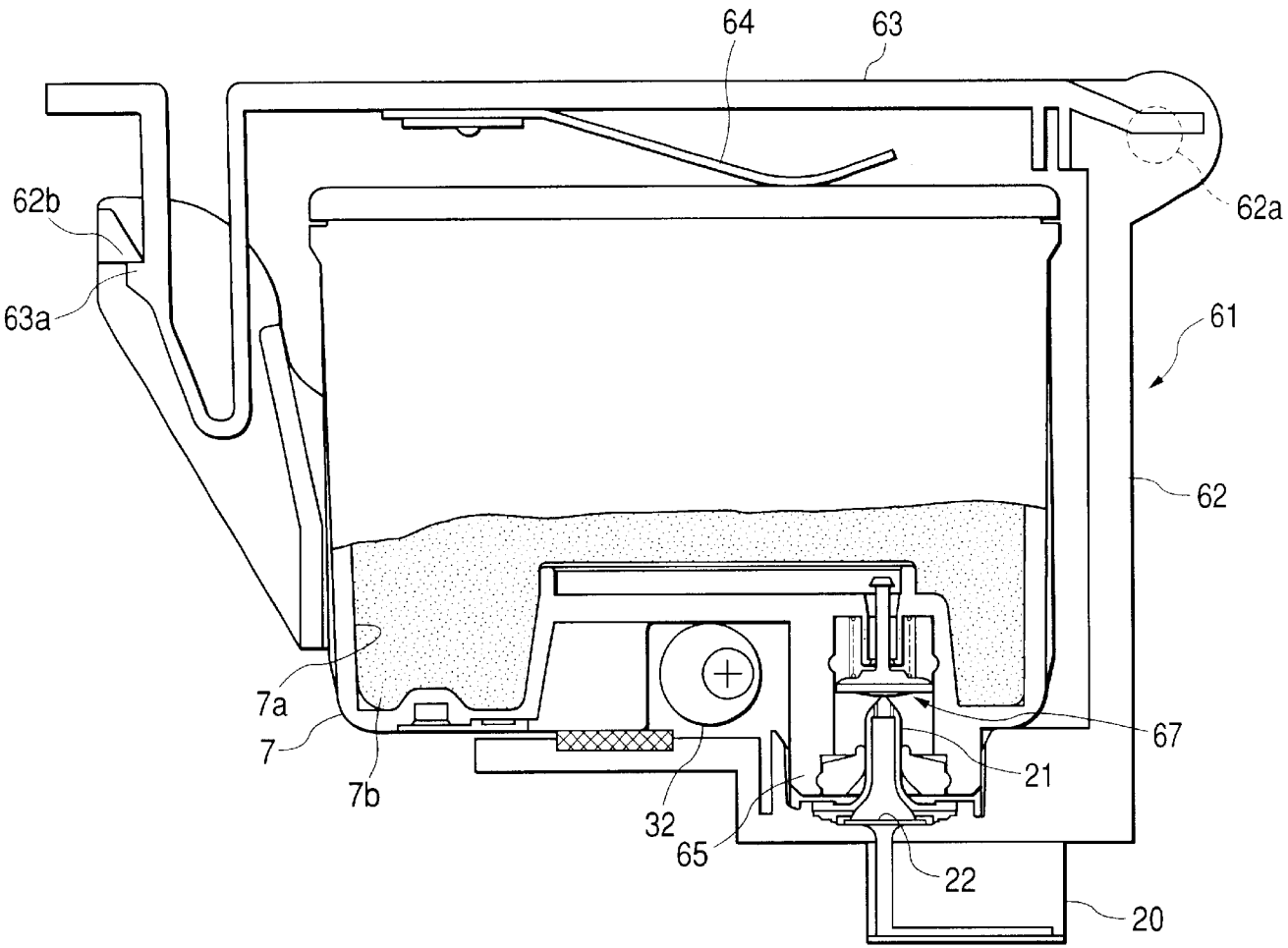
FIG. 21 is a cross sectional view showing a structure including an ink cartridge of a third mode and a cartridge holder to which the ink cartridge is loaded.

An ink cartridge of a third mode of the present invention and an ink jet recording device using the same will be described. FIG. 21 is a cross sectional view, broken in part, showing a structure including a cartridge holder disposed on a carriage and an ink cartridge of a third mode of the invention mounted thereto.

A cartridge holder 61 is constructed with a holder case 62 which is opened in the upper end to have an opening permitting attachment and detachment of the ink cartridge, and a lid 63 which is provided at one end of the holder case and is turned through a hinge mechanism 62*a* to open and close the opening.

A free side end of the lid 63 is shaped like U to form a hook part 63*a*, which is brought into engagement with an engaging part 62*b* formed on the holder case. Through the engagement of them, the lid 63 maintains the closing state of the cartridge holder.

A leaf-like spring member 64 is mounted on the reverse side of the holder case 62. The spring member urges an ink cartridge (to be described later) loaded to the holder toward the bottom. A recording head 20 is mounted on the lower surface of the holder case 62 forming the cartridge holder 61.

A hollow ink supplying needle 21 stands upward from the bottom of the holder case. The ink supplying needle serves as an ink introducing part for introducing ink from the loaded ink cartridge to the recording head 20.

The ink cartridge set to the cartridge holder 61 is the black ink cartridge 7 already stated, in this instance. The ink cartridge 7 is formed with an ink storage chamber 7*a* as the ink cartridge of the second mode does so. The ink storage chamber contains a porous material 7*b*, which is impregnated with ink.

The color ink cartridge 8 is different from the black ink cartridge 7 in that ink storage chambers containing ink of yellow, magenta and cyan are separately disposed side by side, but structural constructions which will be described later are substantially the same.

An ink supply port 65 is disposed on the bottom of the ink cartridge 7. The ink supplying needle 21, which is coupled to the ink supply port 65, supplies ink from the ink cartridge to the recording head 20 via the filter member 22. Within the ink supply port 65, a passage control system 67 is disposed which is operated for valve opening in response to a relative pressing force from the ink supplying needle 21 (as will be described later), and allows the ink to flow from the ink storage chamber to the recording head.

The ink cartridge 7 is urged downward by the spring member 64 in a state that it is put in the holder case 62 as shown in FIG. 21. An eccentric cam mechanism 32 as an actuator is located on the bottom of the holder case 62. The ink cartridge 7 is vertically movable within the holder case 62 through the rotational drive of the eccentric cam mechanism 32.

Figure 22:
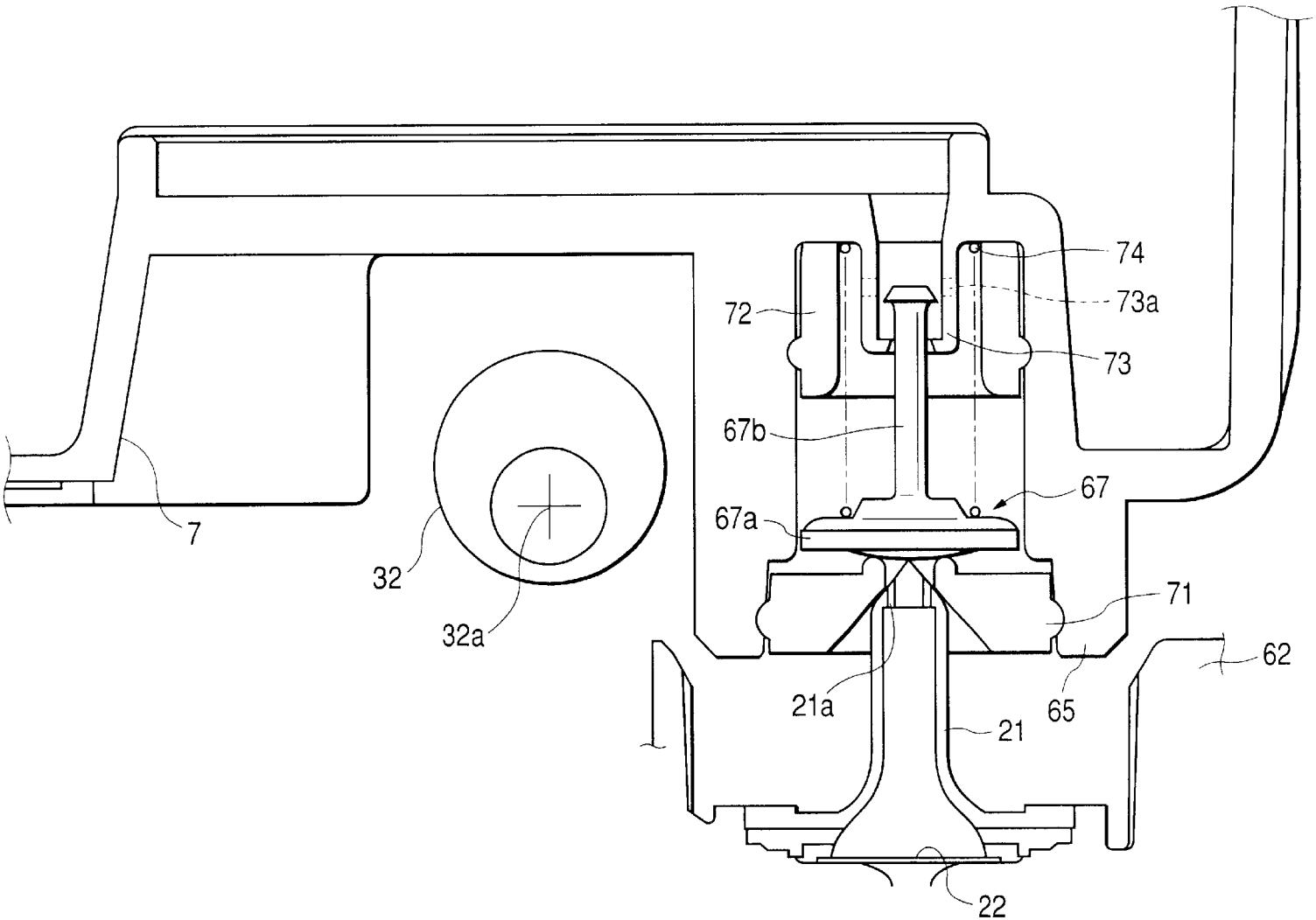
FIG. 22 is an enlarged, cross sectional view showing a state that the FIG. 21 ink cartridge is loaded to the cartridge holder.
Figure 23:
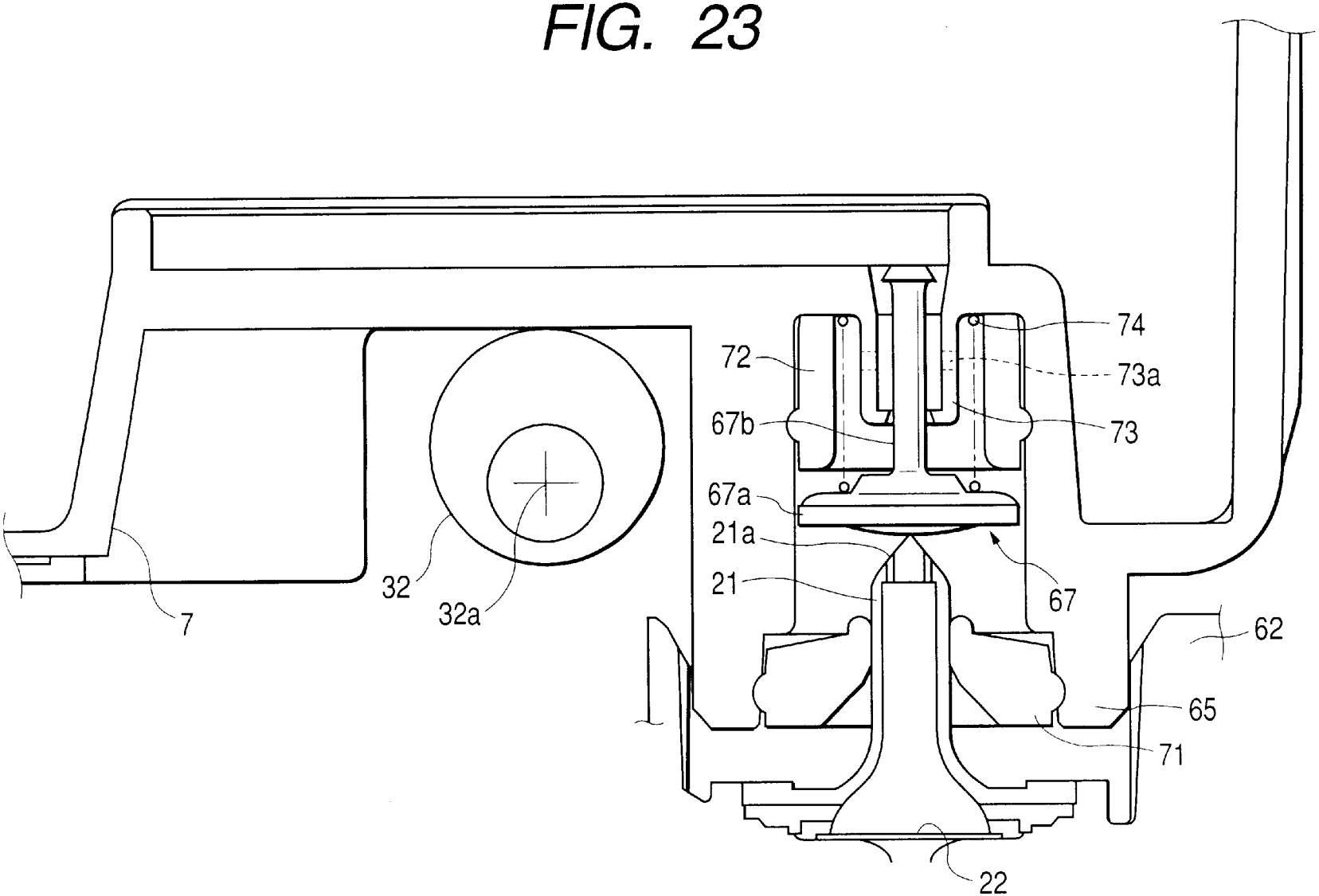
FIG. 23 is an enlarged, cross sectional view showing a state of a structure part in which the ink cartridge is loaded to the cartridge holder, and the supplying of ink to the recording head is allowed.
Figure 24:
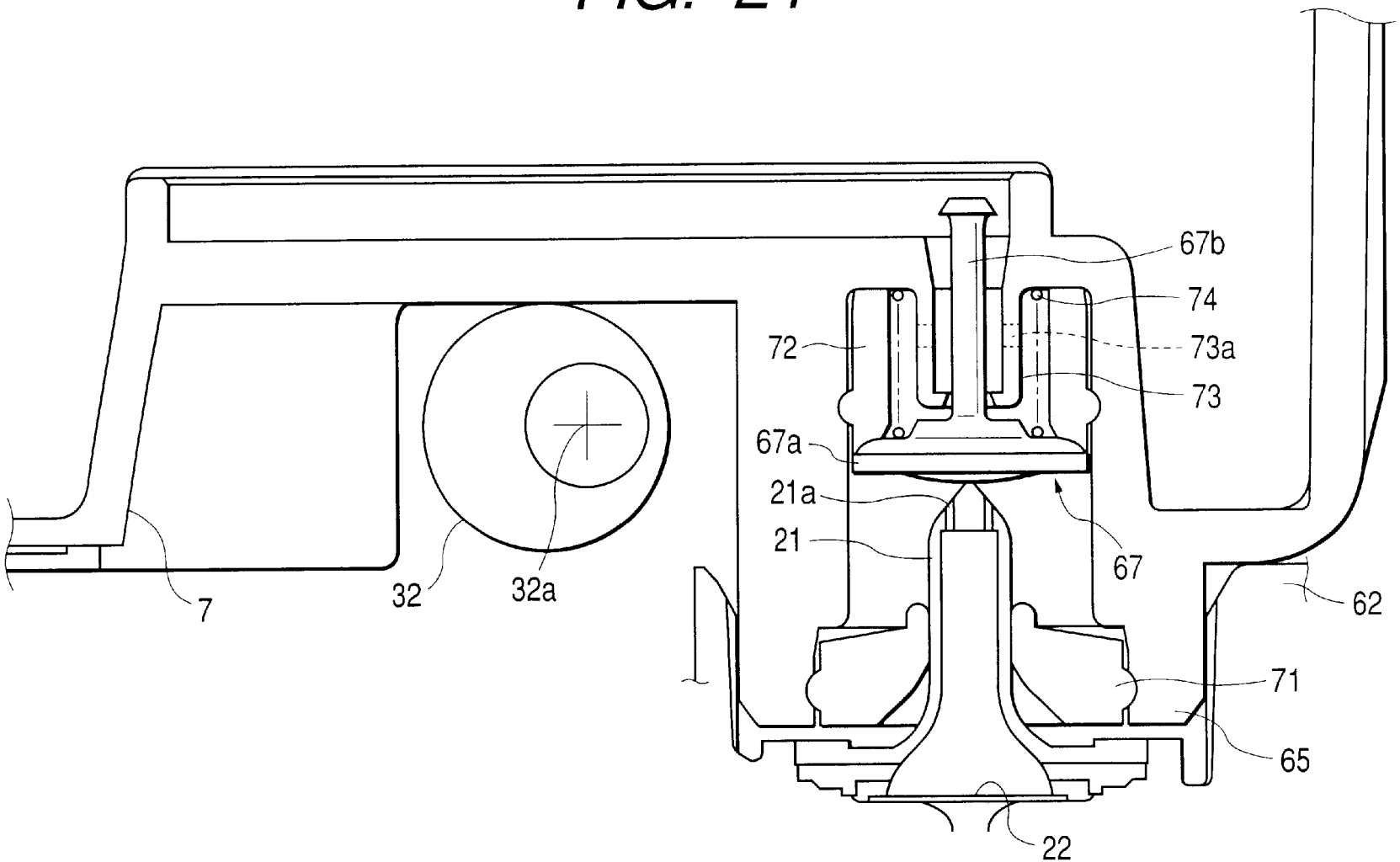
FIG. 24 is an enlarged, cross sectional view showing a state of a structure part in which the supplying of ink to the recording head is halted.

FIGS. 22 to 24 show a structure of the bottom of the cartridge holder, and a structure of the bottom of the ink cartridge loaded to the same. FIG. 22 shows a state just before the ink cartridge is loaded to the cartridge holder, and FIG. 23 shows a state that the ink cartridge is loaded to the cartridge holder, and the supplying of ink to the recording head is allowed. FIG. 24 shows a state that the ink cartridge is loaded to the cartridge holder, and the supplying of ink from the ink storage chamber is halted by the eccentric cam mechanism 32 (the passage control system 67 is put to a valve closing state).

In FIGS. 22 to 24, like or equivalent numerals are used for designating like portions in the drawings already referred to.

As shown in FIGS. 22 to 24, a cylindrical volume is formed within the ink supply port 65 of the ink cartridge 7. A first packing member 71, which is also cylindrical, is fit to the exit part of the ink supply port 65. A second packing member 72, which is also cylindrical, is fit to the innermost part of the ink supply port 65.

The passage control system 67 is constructed with a disc like member 67*a* and a shaft 67*b* for guiding the disc like member in its movement. A bearing piece 73 for receiving the shaft 67*b* is projected into the inner space of the second packing member 72. With such a structure, the disc like member 67*a* forming the passage control system 67 is movable in the axial direction of the shaft 67*b*.

A coiled spring member 74, wound around the shaft 67*b*, is disposed between the disc like member 67*a* and the innermost part of the ink supply port 65. The disc like member 67*a* is urged to the exit of the ink supply port 65 by the spring member 74.

Accordingly, just before the ink cartridge is set to the cartridge holder 61 as shown in FIG. 22, one surface of the disc like member 67*a* is brought into contact with the first packing member 71, whereby the valve closing state is maintained.

Therefore, the ink supply port is placed to a valve closing state by the disc like member 67*a* of the ink supply port 65 when the ink cartridge is not set to the recording device. Accordingly, even when the ink cartridge is removed from the recording device during its use, there is no chance that the ink leaks out of the ink cartridge or air enters the ink cartridge. Accordingly, that ink cartridge may be loaded again to the recording device.

When the ink cartridge is loaded to the cartridge holder 61, the ink supplying needle 21 of the cartridge holder enters the ink supply port 65 of the ink cartridge, as shown in FIG. 23.

As a result, the disc like member 67*a* of the ink supply port 65 is pushed upward with the tip of the ink supplying needle 21, so that disc like member 67*a* is separated from the first packing member 71 and a valve opening state is set up.

At the same time, the ink supplying needle 21 is brought into contact with the inner surface of the first packing member 71, so that a liquid tight state is set up between it and the ink supply port 65.

In a state of the eccentric cam mechanism 32 as an actuator shown in FIG. 23, a cam surface remote from a shaft core 32*a* is directed upward. Accordingly, the ink cartridge is brought into contact with the cam surface, and the state shown in FIG. 23 is maintained.

In this state, the disc like member 67*a* is positioned at a mid position between the first packing member 71 and the second packing member 72. Accordingly, the ink is introduced from the ink storage chamber of the ink cartridge to the ink supplying needle 21 via an ink passing hole 73*a* formed in the bearing piece 73, and then to the recording head 20. Accordingly, in this state, the recording device may perform the printing operation.

When in the FIG. 23 state, the eccentric cam mechanism 32 of the actuator is turned about 90°, the ink cartridge 7 is further moved toward the bottom of the cartridge holder by the spring member 64 of the lid 63 of the cartridge holder 61, as shown FIG. 24.

Accordingly, the ink supplying needle 21 being in contact with the inner surface of the first packing member 71 further moves to the inner part of the ink supply port 65. Accordingly, the disc like member 67*a* is pushed up with the tip of the ink supplying needle 21, and the reverse side of the disc like member 67*a* is brought into contact with the second packing member 72, whereby the valve closing state is set up. As a result, the supplying of the ink from the ink chamber is halted.

In this way, the valve opening state shown in FIG. 23 and the valve closing state shown in FIG. 24 are set up by reciprocatively rotating the eccentric cam mechanism 32 within an angular range of 90°.

The mode of the invention to be described hereunder is that the cleaning operation is effectively performed by the utilization of the valve opening/closing function resulting from the above-mentioned operation.

Figure 1A:
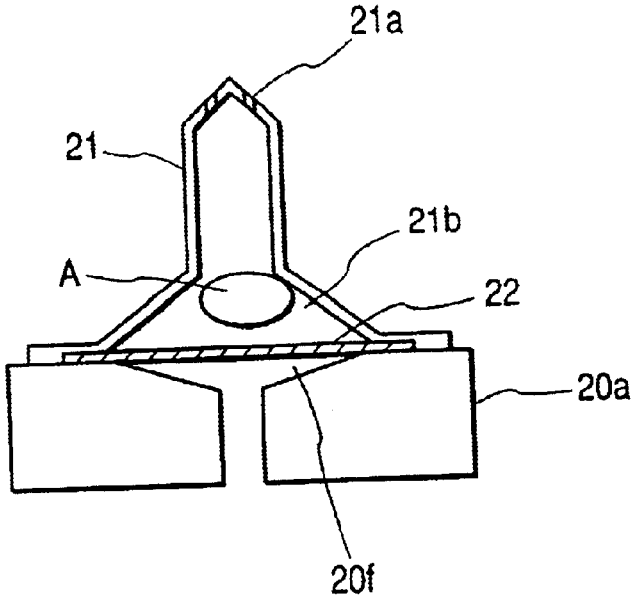
FIG. 1 is a cross sectional view showing a part of an ink cartridge mounting structure in an ink jet recording device.
Figure 1B:
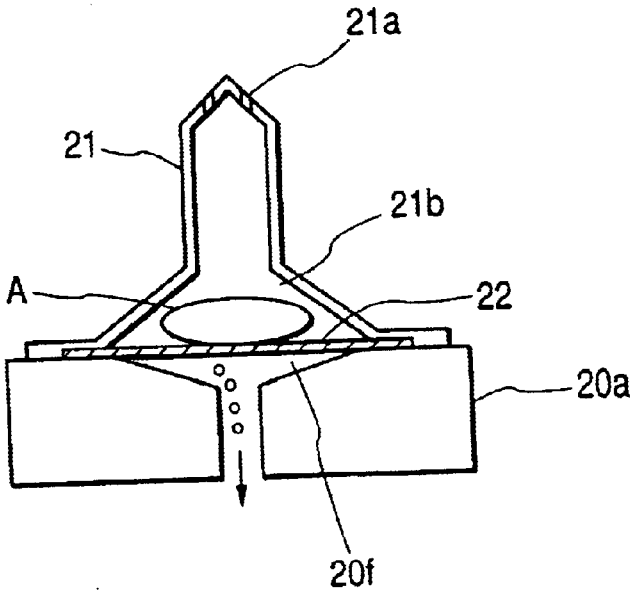
PRIOR ART FIG. 1(B)

Specifically, the cleaning operation is performed in a valve closing state that the reverse side of the disc like member 67*a* is brought into contact with the second packing member 72 as shown in FIG. 24. And the carriage 1 shown in FIG. 1 is moved to the home position, so that the nozzle forming surface of the recording head is sealed with the capping system 9.

When the suction pump 10 is driven in this state, a negative pressure is accumulated in the inner space of the capping system 9. When the negative pressure is sufficiently accumulated, the air bubbles staying within the ink supplying needle 21 are expanded by the negative pressure.

When in this state, the eccentric cam mechanism 32 is turned by 90°, a valve opening state is set up as shown in FIG. 23. As a result, a fast ink flow is generated instantaneously. Accordingly, the air bubbles within the ink supplying needle 21 are rapidly pulled to the filter member 22 and discharged through the filter member 22 to the capping system 9.

By this action, the air bubbles staying at the stagnant parts in the ink flow passage of the head case in the recording head are also discharged effectively.

The cleaning operation based on the accumulated negative pressure may also be realized by using the FIG. 17 control circuit. Specifically, the actuator drive system 52 shown in FIG. 17 drives and rotates the eccentric cam mechanism 32, i.e. the actuator, and moves the disc like member forming the passage control system of the ink cartridge. As a result, the valve opening or closing state is set up.

The cleaning operation of the recording head performed by the control circuit of FIG. 17 is executed in accordance with the FIG. 18 operation sequence.

When receiving a cleaning operation command issued by operating the operation switch 51 of the recording device or operating the input unit 42 of the host computer 40, the cleaning sequence control system 49 produces control signals to start the cleaning operation.

And the cleaning sequence control system 49 sends a command signal to the carriage drive system 53 to drive the carriage motor 2. The carriage 1 passes through the wiping member having entered to its moving path, and as a result, the nozzle forming surface of the recording head 20 is wiped out by the wiping member 11 (step S11).

Subsequently, the carriage 1 is moved to the home position (step S12), and with this, the nozzle forming surface of the recording head 20 is capped with the capping system 9 (step S13).

At the same time, the passage control system is operated for valve closing (step S14). Specifically, the cleaning sequence control system 49 sends a command signal to the actuator drive system 52 to drive the eccentric cam mechanism 32, i.e. the actuator. As a result, the disc like member 67*a* forming the passage control system of the ink cartridge 7 brought into engagement with the second packing member 72 to seal it therewith. A valve closing state is set up.

Subsequently, the driving of the suction pump 10 starts (step S15). This is achieved in a manner that the cleaning sequence control system 49 shown in FIG. 17 sends a control signal to the cleaning control system 47, and the cleaning control system 47 in turn sends a command signal to the pump drive system 48. As a result, the suction pump 10 is driven, a negative pressure is applied to the inner space of the capping system 9, and the negative pressure is incrementally accumulated.

In this state, the control waits till a predetermined time (1) elapses after the start of driving the suction pump 10 (step S16). When the negative pressure applied to the capping system 9 reaches its peak value or therearound, the passage control system, or the disc like member 67*a* of the ink cartridge 7, is operated for valve opening (step S17).

In this case, the sequence control system 49 manages the predetermined time (1), and sends a control signal to the eccentric cam mechanism 32. As a result, the valve opening operation by the disc like member 67*a* of the ink cartridge 7 is performed.

And the control waits till a predetermined time (2) elapses after the valve opening operation of the disc like member 67*a* (step S18). When it is judged that the predetermined time (2) elapsed in the step S18, the driving of the suction pump 10 is halted (step S19). In this case, the sequence control system 49 manages the predetermined time (2) and sends a control signal to the cleaning control system 47, thereby halting the driving of the suction pump 10.

A variation of the negative pressure applied to the capping system 9 in the control sequence from the steps S15 to S19 may be depicted similarly to that shown in FIG. 19. When the suction pump 10 driving starts, the negative pressure relatively sharply rises in the inner space of the capping system 9 as shown in FIG. 19. When the predetermined time (1) elapses and the negative pressure reaches a peak value or therearound, the disc like member 67*a* of the ink cartridge 7 is moved for valve opening.

Then, the negative pressure is rapidly released and approaches atmosphere pressure. At this time, the suction pump 10 driving continues. Accordingly, the negative pressure does not rise to atmosphere pressure and settles down to a predetermined negative pressure. When the predetermined time (2) elapses after the valve opening by the disc like member 67*a* of the ink cartridge 7, the driving of the suction pump is halted, and the negative pressure rises to atmosphere pressure.

As seen from the negative pressure characteristic shown in FIG. 19, the disc like member 67*a* is moved for valve opening at a time point that the predetermined time (1) terminates. As a result, a fast ink flow is generated in the ink flow passage from the ink cartridge to the nozzle apertures of the ink cartridge 7. The air bubbles staying in the ink flow passage is effectively moved on the fast ink flow.

Also during the predetermined time (2), the driving of the suction pump 10 continues, and the air bubbles are discharged along with the ink flow.

Returning to FIG. 18, the capping of the recording head 20 by the capping system 9 is released (step S20). Then, the driving of the suction pump 10 is temporarily driven and then halted (step S21). Consequently, the waste ink discharged into the capping system 9 is wasted to the waste liquid tank 12 by the suction pump 10.

The subsequent step S22 checks if the number of ink suctions reaches a predetermined number. If it is below the predetermined one, the sequence from the steps S13 to S21 is repeated. If the step S22 judges that it reaches the predetermined one, the wiping operation is executed (step S23). The ink left on the nozzle forming surface of the recording head is wiped out by the wiping member 11 (step S23). The recording head 20 is sealed with the capping system 9 (step S24), and waits for incoming print data.

The cleaning operation using the ink cartridge of the third mode described above has been discussed with reference to the manual cleaning operation executed by operating the operation switch 51 of the recording device or operating the input unit 42 of the host computer 40. However, it is useful to program the sequence of the cleaning operation to be executed in an initial ink filling operation for initially filling ink to the recording device.

In the initial ink filling operation, a number of air bubbles are likely to stay within the ink supplying needles and the ink flow passages of the recording head.

Accordingly, it is desirable that the ink to be initially filled to the recording head has a high degassed rate. However, there is a limit in increasing the degassed rate above a certain level. After the initial ink filling or charging, the ink is fed to the ink flow passage while replacing with an air layer. Accordingly, the degassed rate rapidly decreases.

In this respect, it is very important to completely discharge the air bubbles at the time of the initial ink charging operation. This ensures a stable printing operation.

It is useful to program the cleaning operation mentioned above to be executed when a manual cleaning command is issued again by user within a predetermined printing quantity as in the case using the ink cartridge of the second mode.

Such a situation that the manual cleaning command is issued again by user within a predetermined printing quantity, is mainly based on the fact that the user recognizes a printing failure and performs the cleaning operation again. In this case, there is a possibility that a relatively large amount of air flows into the ink flow passage of the recording head to hider the ink charging ability.

When a manual cleaning command is issued again by user within a predetermined printing quantity, it is suggestible that the control routine as of the FIG. 20 case is executed. The control routine utilizing the ink cartridge of the second mode has been already described as an example. Hence no repeated description on it will be given here.

The cleaning operation described above has been discussed on condition that the disc like members 67*a* of the passage control systems of the black and color ink cartridges are concurrently operated for valve opening and closing.

In other words, the cleaning operations has been discussed on condition that a negative pressure accumulating step in which the nozzle forming surface of the recording head is sealed with the capping system, the disc like members 67*a* of the ink cartridges are each put to a valve closing state and in this state, a negative pressure is applied from the suction pump to be accumulated in the capping system, and a negative pressure releasing step in which the disc like members 67*a* of the ink cartridges are each placed to a valve opening state in a state that the negative pressure is accumulated in the capping system, are each executed concurrently.

Ink high in coloring density, e.g., suffers from a problem in that the restoring ability by the cleaning operation is low in comparison to ink of other colors. Accordingly, when the operation sequence mentioned above is used, the nozzles ejecting color ink first resumes their normal ejecting function, and the color ink is further discharged into the capping system, whereas a negative pressure is hard to act on the nozzles ejecting the black ink.

To cope with the problem, it is desirable to independently control the respective disc like members 67*a* as the passage control systems by the actuators 32.

In this case, the negative pressure accumulating step and the negative pressure releasing step are capable of driving only the disc like member 67*a* of a specific ink cartridge. Such a control is also possible that the negative pressure accumulating step is executed concurrently and only the negative pressure releasing step is executed for only a specific ink passage.

With the control, the negative pressure is effected to only the ink cartridge storing specific ink, whereby the cleaning operation is performed.

For example, the disc like members 67*a* respectively provided to the ink supply ports of the black ink cartridge and color ink cartridge are controlled to be closed concurrently, and the negative pressure is applied thereto, and then the disc like member 67*a* in the black ink cartridge is controlled to be open, whereby ink can be discharged only from nozzles for the black ink high in coloring density by the negative pressure. This makes it possible to concentrically execute the cleaning operation on the nozzles ejecting the black ink.

The cleaning process for the nozzles ejecting specific ink is preferably executed by using a control program installed in the recording device. In this case, the cleaning process for the nozzles ejecting specific ink is preferably performed depending on a left standing time after the printing operation of the recording device ends.

The cleaning operation corresponding to the specific ink is preferably performed by using a utility of a print driver of a host computer, or it is designated by a button (not shown) or the like provided on the recording device, and the cleaning operation is preferably performed corresponding to a specific ink cartridge in accordance with the designation information.

In the above-mentioned embodiment, the eccentric cam mechanism 32, i.e. the actuator, which is provided on the cartridge holder, is electrically driven to rotate. The eccentric cam mechanism 32 may manually be rotated, if necessary. To electrically control the actuator, another device, e.g., an electromagnetic plunger, maybe used instead of the eccentric cam mechanism.

As seen from the foregoing description, the ink cartridge of the third mode uses the passage control system which, when it is loaded to the recording device, is operated for valve opening when receiving a pressing force from the ink introducing part of the recording device and is operated for valve closing state when receiving a further pressing force therefrom. Accordingly, the passage control system can be opened and closed depending on the pressing force of the ink introducing part. Therefore, the air bubbles staying, for example, in the supplying needle is effectively discharged by releasing the passage control system in a state that the negative pressure is accumulated in the inner space of the capping system.

The ink jet recording device using the cleaning control method according to the present invention, when using the ink cartridge of the third mode, performs an effective cleaning operation. Since the flow passage control systems can be individually controlled in a cartridge by cartridge basis, the cleaning operation is efficiently performed corresponding to specific ink.

What is claimed is:

1. An ink cartridge which is detachably mounted to a recording device and which communicates with a recording head to supply ink to the recording head during printing, comprising:

an ink supply passage through which ink is supplied from said ink cartridge to said recording device during printing; and a closeable region provided to said ink supply passage and capable of closing a part of said ink supply passage when said recording head provides an ink suction force to said ink supply passage, wherein closing said part of said ink supply passage prevents ink from being supplied from said ink cartridge to said recording head while the ink suction force is provided.

2. An ink cartridge according to claim 1, further comprising:

a container including an ink storage chamber for storing ink;

an ink supply port at least partially forming said ink supply passage extending from said ink storage chamber, and adapted to receive an ink supplying needle communicating with said recording head.

3. The ink cartridge according to claim 1, wherein the closeable region is capable of selectively opening and closing when said recording head provides said ink suction force.

4. An ink cartridge which is detachably mounted to a recording device and which communicates with a recording head to supply ink to the recording head during printing, through an ink introducing part provided on the recording device, comprising:

an ink supply port;

an ink storage chamber for storing ink;

an ink flow passage extending from said ink storage chamber to said ink supply port for supplying ink to said recording head during printing; and a passage control system provided to said ink flow passage, wherein said passage control system closes said ink flow passage or increases flow resistance of said ink flow passage by receiving a drive force from an actuator.

5. An ink cartridge according to claim 4, further comprising:

a packing member disposed in said ink supply port, and adapted to be coupled to said ink introducing part when said ink cartridge is mounted to said recording device.

6. An ink cartridge according to claim 4, wherein said passage control system includes a passage opening/closing system capable of opening and closing said ink flow passage by receiving a drive force from said actuator.

7. An ink cartridge according to claim 4, wherein said actuator is disposed on said recording device, and said passage control system receives a drive force from said actuator in a state that said ink cartridge is mounted to the said recording device.

8. An ink cartridge according to claim 4, wherein said passage control system opens said ink flow passage in a state that said passage control system does not receive a drive force from said actuator.

9. An ink cartridge according to claim 4, wherein said actuator is constructed by an electromagnetic drive mechanism.

10. An ink cartridge according to claim 4, wherein said actuator is constructed by a cam mechanism.

11. An ink cartridge which is detachably mounted to a recording device and supplies ink to a recording head through an ink introducing part provided on the recording device, comprising:

an ink supply port;

an ink storage chamber for storing ink;

an ink flow passage extending from ink storage chamber to said ink supply port; and a passage control system provided to said ink flow passage, wherein said passage control system closes said ink flow passage or increases flow resistance of said ink flow passage by receiving a drive force from an actuator, wherein said passage control system includes a flow resistance varying system capable of varying flow resistance of said ink flow passage by receiving a drive force from said actuator.

12. An ink cartridge which is detachably mounted to a recording device and supplies ink to a recording head through an ink introducing part provided on the recording device, comprising:

an ink supply port;

an ink storage chamber for storing ink;

an ink flow passage extending from ink storage chamber to said ink supply port; and a passage control system provided to said ink flow passage, wherein said passage control system closes said ink flow passage or increases flow resistance of said ink flow passage by receiving a drive force from an actuator, wherein said passage control system includes a sealing member formed of an elastic material which is deformed by receiving a drive force of said actuator, and said ink flow passage is closed or its flow resistance is varied by deformation of said sealing member.

13. An ink cartridge which is detachably mounted to a recording device and supplies ink to a recording head through an ink introducing part provided on the recording device, comprising:

an ink supply port;

an ink storage chamber for storing ink;

an ink flow passage extending from ink storage chamber to said ink supply port; and a passage control system provided to said ink flow passage, wherein said passage control system closes said ink flow passage or increases flow resistance of said ink flow passage by receiving a drive force from an actuator, wherein said actuator is installed in said ink cartridge.

14. An ink cartridge which is detachably mounted to a recording device and supplies ink to a recording head through an ink introducing part provided on the recording device, comprising:

an ink supply port;

an ink storage chamber for storing ink;

an ink flow passage extending from ink storage chamber to said ink supply port; and a passage control system provided to said ink flow passage, wherein said passage control system closes said ink flow passage or increases flow resistance of said ink flow passage by receiving a drive force from an actuator, wherein said ink cartridge is an ink cartridge provided with a plurality of ink storage chambers independently storing ink of plural colors and communicating with respective ink supply ports, said ink flow passages are formed respectively from said ink storage chambers to said ink supply ports, and said passage control system is individually located in each said ink flow passage to close each said ink flow passage or increase flow resistance thereof by receiving a drive force from a respective actuator.

15. An ink cartridge which is detachably mounted to a recording device and supplies ink to a recording head through an ink introducing part provided on the recording device, comprising:

an ink supply port;

an ink storage chamber for storing ink;

an ink flow passage extending from ink storage chamber to said ink supply port; and a passage control system provided to said ink flow passage, wherein said passage control system closes said ink flow passage or increases flow resistance of said ink flow passage by receiving a drive force from an actuator, wherein ink degassed to 5 ppm or lower is stored into said ink storage chamber.

16. An ink cartridge which is detachably mounted to a recording device and supplies ink to a recording head through an ink introducing part provided on the recording device, comprising:

an ink supply port;

an ink storage chamber for storing ink;

an ink flow passage extending from ink storage chamber to said ink supply port; and a passage control system provided to said ink flow passage, wherein said passage control system closes said ink flow passage or increases flow resistance of said ink flow passage by receiving a drive force from an actuator, wherein when said ink cartridge is in a storage state, said ink cartridge is packed in a reduced pressure state by a packing member having a gas barrier property.

17. An ink cartridge which is detachably mounted to a recording device and supplies ink to a recording head through an ink introducing part provided on the recording device, comprising:

an ink supply port;

an ink storage chamber for storing ink;

an ink flow passage extending from ink storage chamber to said ink supply port; and a passage control system provided to said ink flow passage, wherein said passage control system closes said ink flow passage or increases flow resistance of said ink flow passage by receiving a drive force from an actuator, wherein said ink cartridge is packed in a reduced pressure state by a packing member having a gas barrier property in a state that said passage control system is covered by a cover member.

18. An ink cartridge which is detachably mounted to a recording device and supplies ink to a recording head, comprising:

an ink supply passage through which ink is supplied from the ink cartridge to said recording device; and a deformable sealing member provided to said ink supply passage and capable of closing or narrowing a part of said ink supply passage by receiving a drive force from an actuator.

19. The ink cartridge according to claim 18, further comprising:

the actuator installed in the ink cartridge and facing the deformable sealing member.

20. The ink cartridge according to claim 1, wherein the closeable region comprises a deformable member.

21. The ink cartridge according to claim 18, wherein further comprising:

an opening provided to the ink cartridge, through which the actuator discrete from the ink cartridge is accessible to the deformable sealing member.

22. The ink cartridge according to any one of claims 18 to 21, further comprising:

an ink supply port defining the ink supply passage, wherein the ink supply port is at least partially deformable to function as the sealing member.

23. The ink cartridge according to any one of claims 18 to 21, further comprising:

an ink supply port as an outlet of the ink supply passage, wherein the sealing member is disposed at a portion of the ink supply passage other than the ink supply port.

24. The ink cartridge according to any one of claims 18 to 21, wherein the sealing member is a tubular elastic member.

25. The ink cartridge according to any one of claims 18 to 21, wherein the sealing member is a disc-shaped elastic member.

* * * * *